US007281980B2

(12) United States Patent
Okada

(10) Patent No.: US 7,281,980 B2
(45) Date of Patent: Oct. 16, 2007

(54) GAMING MACHINE

(75) Inventor: Kazuo Okada, Tokyo (JP)

(73) Assignee: Aruze Co., Ltd., Tokyo (JP)

( * ) Notice: Subject to any disclaimer, the term of this patent is extended or adjusted under 35 U.S.C. 154(b) by 0 days.

(21) Appl. No.: 10/602,212

(22) Filed: Jun. 24, 2003

(65) Prior Publication Data

US 2004/0063490 A1 Apr. 1, 2004

(30) Foreign Application Priority Data

Jun. 25, 2002 (JP) ..... 2002-184601
Aug. 27, 2002 (JP) ..... 2002-246172

(51) Int. Cl.
*G07F 17/34* (2006.01)

(52) U.S. Cl. ..... 463/20; 463/31; 463/32; 273/138.2

(58) Field of Classification Search ..... 273/143 R, 273/138.1, 138.2; 463/20, 31, 34, 32, 3
See application file for complete search history.

(56) References Cited

U.S. PATENT DOCUMENTS 5,697,843 A * 12/1997 Manship et al. ..... 463/20
6,036,189 A 3/2000 Gomez et al.
6,086,066 A * 7/2000 Takeuchi et al. ..... 273/143 R
6,517,433 B2 * 2/2003 Loose et al. ..... 463/20
2001/0031658 A1 * 10/2001 Ozaki et al. ..... 463/16
2002/0036648 A1 3/2002 Putilin
2002/0077172 A1 6/2002 Takashi et al.
2003/0130028 A1 * 7/2003 Aida et al. ..... 463/20

FOREIGN PATENT DOCUMENTS

EP 1 260 928 11/2002
JP 4-220276 8/1992
JP A 06 142278 5/1994
JP 11-9761 1/1999

(Continued)

OTHER PUBLICATIONS

European Search Report, dated Mar. 22, 2005.
European Search Report, dated Jun. 16, 2006; 5 pages.

*Primary Examiner*—Benjamin Layno
(74) *Attorney, Agent, or Firm*—Collard & Roe, P.C.

(57) ABSTRACT

In order to provide a gaming machine which enables selective clear display of patterns of reels and performance images displayed on front side display means arranged in front of the reels as needed, a gaming machine comprises: variable display means for variably displaying a plurality of patterns; front side display means, which is arranged in front of said variable display means, and through which the patterns of the variable display means can be seen; internal prize-winning-combination determination means for determining an internal-win-combination; a plurality of operation means for stopping the variable display of said variable display means; stop control means for stopping and controlling a variable display operation of said variable display means based or the result of determination of said internal-win-combination determination means and an operation of said operation means; and game media disbursement means for disbursing game media when a stop mode of the variable display means stopped by said stop control means is a predetermined stop mode,
wherein said front side display means is configured so as to stack a plurality of panel-shaped displays.

20 Claims, 40 Drawing Sheets

FOREIGN PATENT DOCUMENTS

| | | |
|---|---|---|
| JP | 11-178992 | 7/1999 |
| JP | 11-206960 | 8/1999 |
| JP | 2000-11725 | 1/2000 |
| JP | A 2000 171821 | 6/2000 |
| JP | 2000 267604 | 9/2000 |
| JP | A 2000 300729 | 10/2000 |
| JP | 2000-350805 | 12/2000 |
| JP | A 2001 62032 | 3/2001 |
| JP | A 2001 252394 | 9/2001 |
| JP | 2001 305246 | 10/2001 |
| JP | 2001-327650 | 11/2001 |
| JP | 2002-291982 | 8/2002 |
| JP | A 2002 229059 | 8/2002 |
| JP | 2002-336473 | 11/2002 |
| JP | 2003-144646 | 5/2003 |
| JP | 2003-144707 | 5/2003 |
| JP | 2003-154075 | 5/2003 |
| JP | 2003-154078 | 5/2003 |
| JP | 2003-164573 | 6/2003 |
| JP | 2003-164576 | 6/2003 |
| JP | 2003-190412 | 7/2003 |
| JP | 2003-190445 | 7/2003 |
| JP | 2003-190487 | 7/2003 |
| JP | 2003-190528 | 7/2003 |
| JP | 2003-190531 | 7/2003 |
| JP | 2003-199886 | 7/2003 |
| JP | 2003-199933 | 7/2003 |
| JP | 2003-199941 | 7/2003 |
| JP | 2003-199942 | 7/2003 |
| JP | 2003-199943 | 7/2003 |
| JP | 2003-199946 | 7/2003 |
| JP | 2003-210773 | 7/2003 |
| WO | WO99/53454 | 10/1999 |

* cited by examiner

Fig. 5

| | left reel | | central reel | | right reel |
|---|---|---|---|---|---|
| 00 | red 7 | 00 | red 7 | 00 | red 7 |
| 01 | cherry | 01 | plum | 01 | bell |
| 02 | blue 7 | 02 | Replay | 02 | Replay |
| 03 | bell | 03 | bell | 03 | BAR |
| 04 | Replay | 04 | cherry | 04 | plum |
| 05 | red 7 | 05 | Replay | 05 | bell |
| 06 | cherry | 06 | cherry | 06 | Replay |
| 07 | blue 7 | 07 | bell | 07 | cherry |
| 08 | bell | 08 | BAR | 08 | blue 7 |
| 09 | Replay | 09 | cherry | 09 | cherry |
| 10 | plum | 10 | Replay | 10 | bell |
| 11 | bell | 11 | bell | 11 | Replay |
| 12 | Replay | 12 | blue 7 | 12 | cherry |
| 13 | BAR | 13 | Replay | 13 | plum |
| 14 | red 7 | 14 | cherry | 14 | bell |
| 15 | bell | 15 | bell | 15 | Replay |
| 16 | plum | 16 | BAR | 16 | cherry |
| 17 | Replay | 17 | plum | 17 | blue 7 |
| 18 | plum | 18 | Replay | 18 | bell |
| 19 | bell | 19 | bell | 19 | Replay |
| 20 | Replay | 20 | cherry | 20 | cherry |

Fig. 6

Winning-combinations and disbursed number corresponding to a prize-winning pattern combination in each play mode

| pattern combination | general play mode | general play mode on BB | RB play mode |
|---|---|---|---|
| red 7 - red 7 - red 7 | BB 15 medals | — | — |
| blue 7- blue 7- blue 7 | BB 15 medals | — | — |
| BAR - BAR - BAR | RB 15 medals | — | — |
| bell - bell - bell | bell's insignificant winning-combination 15 medals | bell's insignificant winning-combination 15 medals | — |
| plum - plum - plum | plum's insignificant winning-combination 6 medals | plum's insignificant winning-combination 6 medals | — |
| Replay - Replay - Replay | re-play 0 medal | RB (JAC IN) 15 medals | bonus 15 medals |
| cherry - any - any | cherry's insignificant winning-combination 2 or 4 medals | cherry's insignificant winning-combination 2 or 4 medals | — |

image which notifies that left stop button should be operated image which notifies that right stop button should be operated image which notifies that central stop button should be operated

Fig. 9 A

Probability lottery table used for general game mode
(Random number extraction range: 0～16383)

| prize-winning-combination | prize-winning random number value range BET number=3 medals | | | probability of internal prize-winning |
|---|---|---|---|---|
| BB | 0 | ～ | 54 | 55 / 16384 |
| RB | 55 | ～ | 82 | 28 / 16384 |
| replay | 83 | ～ | 2327 | 2245 / 16384 |
| bell's insignificant winning-combination | 2328 | ～ | 10919 | 8592 / 16384 |
| plum's insignificant winning-combination | 10920 | ～ | 10973 | 54 / 16384 |
| cherry's insignificant winning-combination | 10974 | ～ | 11036 | 63 / 16384 |

Fig. 9 B probability lottery table used for general game mode "on BB"
(Random number extraction range: 0～16383)

| prize-winning-combination | prize-winning random number value range BET number=3 medals | | | probability of internal prize-winning |
|---|---|---|---|---|
| BB | — | ～ | — | 0 / 16384 |
| RB | — | ～ | — | 0 / 16384 |
| replay (RB "on BB") | 0 | ～ | 4199 | 4200 / 16384 |
| bell's insignificant winning-combination | 4200 | ～ | 14499 | 10300 / 16384 |
| plum's insignificant winning-combination | 14500 | ～ | 16319 | 1820 / 16384 |
| cherry's insignificant winning-combination | — | ～ | — | 0 / 16384 |

Fig. 10

Stop control table number selection table (Random number extraction range: 0~255)

| Table No. | prize-winning random number value range BET number=3 medals | | | selection probability |
|---|---|---|---|---|
| No. 1 | 0 | ~ | 42 | 43 / 256 |
| No. 2 | 43 | ~ | 85 | 43 / 256 |
| No. 3 | 86 | ~ | 128 | 43 / 256 |
| No. 4 | 129 | ~ | 171 | 43 / 256 |
| No. 5 | 172 | ~ | 213 | 42 / 256 |
| No. 6 | 214 | ~ | 255 | 42 / 256 |

Fig. 11

Relationship among Table No., stop sequence and achievement/failure of "bell's insignificant winning-combination"

| | | Table No. | | | | | |
|---|---|---|---|---|---|---|---|
| | | 1 | 2 | 3 | 4 | 5 | 6 |
| Stop sequence | LEFT CENTER RIGHT | achieved (win) | not achieved (lose) | not achieved (lose) | not achieved (lose) | not achieved (lose) | not achieved (lose) |
| | LEFT RIGHT CENTER | not achieved (lose) | achieved (win) | not achieved (lose) | not achieved (lose) | not achieved (lose) | not achieved (lose) |
| | CENTER LEFT RIGHT | not achieved (lose) | not achieved (lose) | achieved (win) | not achieved (lose) | not achieved (lose) | not achieved (lose) |
| | CENTER RIGHT LEFT | not achieved (lose) | not achieved (lose) | not achieved (lose) | achieved (win) | not achieved (lose) | not achieved (lose) |
| | RIGHT LEFT CENTER | not achieved (lose) | not achieved (lose) | not achieved (lose) | not achieved (lose) | achieved (win) | not achieved (lose) |
| | RIGHT CENTER LEFT | not achieved (lose) | not achieved (lose) | not achieved (lose) | not achieved (lose) | not achieved (lose) | achieved (win) |

Fig. 12

Stop control table for winning (internal-win-combination: bell's insignificant winning-combination)

| left reel | | central reel | | right reel | |
|---|---|---|---|---|---|
| stop operation position | stop control position | stop operation position | stop control position | stop operation position | stop control position |
| 00 | 19 | 00 | 19 | 00 | 18 |
| 01 | 19 | 01 | 19 | 01 | 01 |
| 02 | 19 | 02 | 19 | 02 | 01 |
| 03 | 03 | 03 | 03 | 03 | 01 |
| 04 | 03 | 04 | 03 | 04 | 01 |
| 05 | 03 | 05 | 03 | 05 | 05 |
| 06 | 03 | 06 | 03 | 06 | 05 |
| 07 | 03 | 07 | 07 | 07 | 05 |
| 08 | 08 | 08 | 07 | 08 | 05 |
| 09 | 08 | 09 | 07 | 09 | 05 |
| 10 | 08 | 10 | 07 | 10 | 10 |
| 11 | 11 | 11 | 11 | 11 | 10 |
| 12 | 11 | 12 | 11 | 12 | 10 |
| 13 | 11 | 13 | 11 | 13 | 10 |
| 14 | 11 | 14 | 11 | 14 | 14 |
| 15 | 15 | 15 | 15 | 15 | 14 |
| 16 | 15 | 16 | 15 | 16 | 14 |
| 17 | 15 | 17 | 15 | 17 | 14 |
| 18 | 15 | 18 | 15 | 18 | 18 |
| 19 | 19 | 19 | 19 | 19 | 18 |
| 20 | 19 | 20 | 19 | 20 | 18 |

Fig. 13

Stop control table for losing of forward push and center push (internal prize-win: bell's insignificant winning-combination)

| left reel | | central reel | | right reel | |
|---|---|---|---|---|---|
| stop operation position | stop control position | stop operation position | stop control position | stop operation position | stop control position |
| 00 | 19 | 00 | 19 | 00 | 19 |
| 01 | 19 | 01 | 19 | 01 | 19 |
| 02 | 19 | 02 | 19 | 02 | 02 |
| 03 | 03 | 03 | 03 | 03 | 02 |
| 04 | 03 | 04 | 03 | 04 | 02 |
| 05 | 03 | 05 | 03 | 05 | 02 |
| 06 | 03 | 06 | 03 | 06 | 06 |
| 07 | 03 | 07 | 07 | 07 | 06 |
| 08 | 08 | 08 | 07 | 08 | 06 |
| 09 | 08 | 09 | 07 | 09 | 06 |
| 10 | 08 | 10 | 07 | 10 | 06 |
| 11 | 11 | 11 | 11 | 11 | 11 |
| 12 | 11 | 12 | 11 | 12 | 11 |
| 13 | 11 | 13 | 11 | 13 | 11 |
| 14 | 11 | 14 | 11 | 14 | 11 |
| 15 | 15 | 15 | 15 | 15 | 15 |
| 16 | 15 | 16 | 15 | 16 | 15 |
| 17 | 15 | 17 | 15 | 17 | 15 |
| 18 | 15 | 18 | 15 | 18 | 15 |
| 19 | 19 | 19 | 19 | 19 | 19 |
| 20 | 19 | 20 | 19 | 20 | 19 |

Fig. 14

Stop control table for losing of reverse push (internal prize-win: bell's insignificant winning-combination)

| left reel | | central reel | | right reel | |
|---|---|---|---|---|---|
| stop operation position | stop control position | stop operation position | stop control position | stop operation position | stop control position |
| 00 | 20 | 00 | 19 | 00 | 18 |
| 01 | 20 | 01 | 19 | 01 | 01 |
| 02 | 20 | 02 | 19 | 02 | 01 |
| 03 | 20 | 03 | 03 | 03 | 01 |
| 04 | 04 | 04 | 03 | 04 | 01 |
| 05 | 04 | 05 | 03 | 05 | 05 |
| 06 | 04 | 06 | 03 | 06 | 05 |
| 07 | 04 | 07 | 07 | 07 | 05 |
| 08 | 04 | 08 | 07 | 08 | 05 |
| 09 | 09 | 09 | 07 | 09 | 05 |
| 10 | 09 | 10 | 07 | 10 | 10 |
| 11 | 09 | 11 | 11 | 11 | 10 |
| 12 | 12 | 12 | 11 | 12 | 10 |
| 13 | 12 | 13 | 11 | 13 | 10 |
| 14 | 12 | 14 | 11 | 14 | 14 |
| 15 | 12 | 15 | 15 | 15 | 14 |
| 16 | 12 | 16 | 15 | 16 | 14 |
| 17 | 17 | 17 | 15 | 17 | 14 |
| 18 | 17 | 18 | 15 | 18 | 18 |
| 19 | 17 | 19 | 19 | 19 | 18 |
| 20 | 20 | 20 | 19 | 20 | 18 |

Fig. 15 A

Ceiling AT Frequency Selection Table

| Number of AT | Lottery Value |
|---|---|
| 1 | 2356 |
| 2 | 1512 |
| 5 | 196 |
| 10 | 28 |
| 30 | 4 |

Fig. 15 B

AT Activating Lottery Table

| | Lottery Value |
|---|---|
| Activating | 32 |
| Latent | 224 |

Fig. 16 A ceiling table activating value selection table

| number of medals | lottery value |
|---|---|
| 1200 | 64 |
| 1500 | 128 |
| 1800 | 64 |

Fig. 16 B ceiling meter shift selection table

| | | 1200 medals | 1500 medals | 1800 medals |
|---|---|---|---|---|
| ceiling meter level | level 1 | 150 | 188 | 225 |
| | level 2 | 300 | 375 | 450 |
| | level 3 | 450 | 563 | 675 |
| | level 4 | 600 | 750 | 900 |
| | level 5 | 750 | 938 | 1125 |
| | level 6 | 900 | 1125 | 1350 |
| | level 7 | 1050 | 1313 | 1575 |
| | level 8 | 1200 | 1500 | 1800 |

Fig. 17 A start command

| 1 | internal-win-combination |
|---|---|
| 2 | BB |
| | RB |
| | replay |
| | bell |
| | plum |
| | cherry |
| | lose |
| | — |
| 3 | play mode |
| 4 | on general mode |
| | on prize-winning in BB |
| | on prize-winning in RB |
| | on BB |
| | on RB |
| | — |
| | — |
| | — |
| 5 | stop control table |
| 6 | table No. 1 |
| | table No. 2 |
| | table No. 3 |
| | table No. 4 |
| | table No. 5 |
| | table No. 6 |
| | — |
| | — |

Fig. 17 B

BB terminating command

| 1 | operation when BB is terminated |
|---|---|
| 2 | game re-start |
| | pay operation |
| | game-over operation |
| | — |
| | — |
| | — |
| | — |
| | — |

Fig. 18 A

Prize-winning command

| 1 | prize-winning-combination |
|---|---|
| 2 | BB |
| | RB |
| | replay |
| | bell |
| | plum |
| | cherry |
| | lose |
| | — |
| 3 | play mode |
| 4 | on general mode |
| | on prize-winning in BB |
| | on prize-winning in RB |
| | on BB |
| | on RB |
| | — |
| | — |
| | — |
| 5 | prize-winning line |
| 6 | middle line |
| | upper line |
| | lower line |
| | upward sloping line |
| | downward sloping line |
| | — |
| | — |
| | — |

Fig. 18 B game medal loading command

| 1 | number of loaded coin (loaded number) |
|---|---|
| 2 | 1 medal |
| | 2 medals |
| | 3 medals |
| | — |
| | — |
| | — |
| | — |
| | — |

GAMING MACHINE

BACKGROUND OF THE INVENTION

1. Field of the Invention

The present invention relates to a slot machine, a pachinko machine, and other gaming machines equipped with variable display means which variably displays patterns required for a game, and control means such as microcomputer or the like which controls the variable displays.

2. Related Art

Conventionally, for example, a slot machine equipped with stopping means, the so-called "pachislo (pinball machine fitted with a slot machine mechanism)" gaming machine, is known as a gaming machine of this kind. FIG. 42 illustrates a common pachislo gaming machine X.

This pachislo gaming machine X arranges a plurality of three rotation reels 104–106 which variably display a plurality of patterns within display windows 101–103 arranged in a front panel 100 and has a variable display device comprising reel stop buttons 107–109 which stop these rotation reels 104–106. Then, a reward is given to a player when a combination of predetermined patterns matches this variable display device.

In addition, corresponding to nine patterns comprising 3 columns ×3 rows displayed through said display windows 101–103, a center prize-winning line 111 for one-medal use which becomes effective by loading one medal, two prize-winning lines 112*a* and 112*b* for two medal use which become additionally effective by loading two medals, and prize-winning-lines 113*a* and 113*b* for three-medal use which become additionally effective by loading three medals are printed on a front side of the front panel 100, respectively. In the view, reference numeral 114 is a slot for game media (medal or coin) and reference numeral 115 is a start lever for starting a game, in addition, in the above-mentioned variable display device, other than a mechanical configuration type using the above-mentioned rotation reels 104–106, there is another type which can variably display the patterns on a liquid crystal display or the like.

To play the game, first, the game is started by loading the game media into the above-mentioned slot 114. Then, patterns are variably displayed by the control means which drives and controls the variable display device, and rotates each of the reels 104–106 by operation of the start lever 115 by the player.

The varied patterns stop the rotation of each of the reels 104–106 automatically after a fixed period of time or by the stop operation of the reel stop buttons 107–109 by the player. Then, when the patterns of each of the reels 104–106 which have appeared in the display window 101–103 constitute a specific combination (prize-winning pattern), a reward will be given to the player by disbursing the game media.

Such a pachislo gaming machine X has a plurality of types of prize-winning modes. Particularly, there are some machines which not only disburse the medals at one time, but also set a better game mode than the normal game mode for a predetermined period when prize-winning of a predetermined prize-winning-combination is achieved. As such prize-winning-combinations, there is a prize-winning-combination (called a "big bonus" and hereinafter referred to as "BB") wherein games, which give the player a relatively large reward, can be played a predetermined number of times, and a prize-winning-combination (called a "regular bonus" and hereinafter referred to as "RB") wherein games, which give a player a relatively small reward, can be played a predetermined number of times.

In addition, in the pachislo gaming machine X, the combination of patterns which are stopped and displayed along a line (hereinafter referred to as "effective line") validated among said prize-winning lines 111–113 is determined by performing an internal lottery process (referred to as "internal lottery") and is then based on this lottery result and a stop operation timing of the reel stop buttons 107–109 by the player. That is, in order to achieve the prize-winning that disburses the medals, coins or the like, it is required that the player achieves the prize-winning-combination according to the above-mentioned internal lottery process (hereinafter referred to as "internal-win"), and performs a stop operation at a timing when the pattern combination, which indicates the prize-winning achievement of the prize-winning-combination internally achieved (referred to as "internal-win-combination"), is stopped on the effective line.

That is, since the prize-winning cannot be achieved when the timing of the stop operation by the player is incorrect even if the internal-win could be achieved, a gaming machine which requires a technique for performing the stop operation with desirable timing (the technical intercurrence called "meoshi (pushing a button by identifying patterns using one's own eyes)" is relatively high in importance) has been in use until now.

In such gaming machines, various techniques for displaying said prize-winning lines 111–113 and patterns, and the idea of placing some features on the front panel 100 have been recently proposed in order to increase playability and make it easier for prize-winning to be distinguished.

The Japanese Unexamined Patent Publication No. Hei-4-220276 discloses a gaming machine wherein three sets of liquid crystal shutters are arranged in the shape of a column at the front side of the display window corresponding to the three rotation reels and, when the game is over, only the prize-winning combination patterns are displayed through a pattern display window, while three prize-winning combination patterns are displayed on the display window by changing the liquid crystal shutter corresponding to the remaining six patterns, which are not prize-winning, to be opaque.

The Japanese Unexamined Patent Publication No. 2000-350805 discloses a gaming machine which comprises an information display panel with optical transparency equipped with a so-called matrix display section which can be displayed by dot patterns through dots of a plurality of rows and a plurality of columns on the rear surface or near the rear surface of the front panel, and further displays optically transparent characters, patterns or the like with the dot patterns on the information display panel by configuring the information display panel using a transparent EL (electroluminescence) panel.

However, in the gaming machine (Japanese Unexamined Patent Publication No. Hei-4-220276) equipped with the liquid crystal shutter mentioned above, although it is possible to reliably conceal patterns which have not won a prize and to clearly display the prize-winning combination pattern, there has been a problem in that the patterns of each rotation reel become difficult to see because lines other than the effective line are also displayed, resulting in continually displaying a plurality of lines, and it is necessary to prepare various indicator lamps, display machines or the like separately, thereby making the configuration complicated.

Moreover, in the gaming machine (Japanese Unexamined Patent Publication No. 2000-350805) equipped with the information display panel, although only the effective line is reliably displayed or various displays including performance images or the like are available, the patterns of each reel are continually seen also through the dot patterns, and the special performance images are always transparently displayed because of the transparent panel, thereby there has been a concern that the patterns of each reel have also become difficult to see due to overlapping said performance images.

SUMMARY OF THE INVENTION

The object of the present invention is to provide a gaming machine which enables clear display of the patterns of the reels and the performance images displayed on the front side display means arranged in front of the reels by solving the above-mentioned problems.

In a first aspect of the invention, a gaming machine, comprising: variable display means for variably displaying a plurality of patterns; front side display means, which is arranged in front of said variable display means, and through which the patterns of variable display means can be seen; internal-win-combination determination means for determining an internal-win-combination; a plurality of operation means for stopping the variable display of said variable display means; stop control means for stopping and controlling a variable display operation of said variable display means based on the result of determination of said internal-win-combination determination means and an operation of said operation means; and game media disbursement means for disbursing game media when the stop mode of the variable display means stopped by said stop control means is a predetermined stop mode, wherein said front side display means is configured so as to stack a plurality of panel-shaped displays.

Moreover, in a second aspect of the invention, the above-mentioned panel-shaped display in said gaming machine uses a liquid crystal panel.

Moreover, in a third aspect of the invention, a hollow portion, which can expose the patterns of variable display means on the panel-shaped display arranged at the side of the above-mentioned variable display means in said gaming machine, is formed.

Here, the variable display means may comprise a variable display device such as a CRT, an LCD, an EL, and so on. The plurality of patterns displayed on the variable display means comprise varying images. The varying images, for example, may be shown through a display section as a reel with a plurality of images rotates. The stop control means may comprise a stop device for stopping the varying images. The front side display means may comprise a front side display device. The front side display device, for example, may comprise a first and a second display panels in front of the variable display device such that the gaming machine has a mode to allow a still image to be seen through the first and second display panels. The still image may comprise one of the varying images. The hollow portion may refer to an opening in the first or second display panel The opening may be surrounded by an opaque member. The first or second panels may have a plurality of openings such that a plurality of still images may be seen through the openings.

BRIEF DESCRIPTION OF THE DRAWINGS

FIG. 5 is a view illustrating a pattern sequence arranged on a reel.

FIG. 6 is a view illustrating a prize-winning-combination and the number of disbursements corresponding to a prize-winning pattern combination.

FIG. 9A is a view illustrating a probability lottery table for a general game mode.

FIG. 9B is a view illustrating a probability lottery table for a general game mode on BB.

FIG. 10 is a view illustrating a stop control table number selection table.

FIG. 11 is a view illustrating a correspondence between a push order for every stop table number and a prize-winning achievement/failure.

FIG. 12 is a view illustrating an example of a stop control table.

FIG. 13 is a view illustrating an example of a stop control table.

FIG. 14 is a view illustrating an example of a stop control table.

FIG. 15A is a view illustrating an AT frequency selection table.

FIG. 15B is a view illustrating an AT activating lottery table.

FIG. 16A is a view illustrating a ceiling activating value selection table.

FIG. 16B is a view illustrating a ceiling meter shift selection table.

FIG. 17A is a view illustrating an example of a start command which is transmitted from a main control circuit to a subcontrol circuit.

FIG. 17B is a view illustrating an example of a terminating command which is transmitted from a main control circuit to a subcontrol circuit.

FIG. 18A is a view illustrating an example of a prize-winning command which is transmitted from a main control circuit to a subcontrol circuit.

FIG. 18B is a view illustrating an example of a game medal loading command which is transmitted from a main control circuit to a subcontrol circuit.

DETAILED DESCRIPTION OF THE PREFERRED EMBODIMENTS

Figure 1:
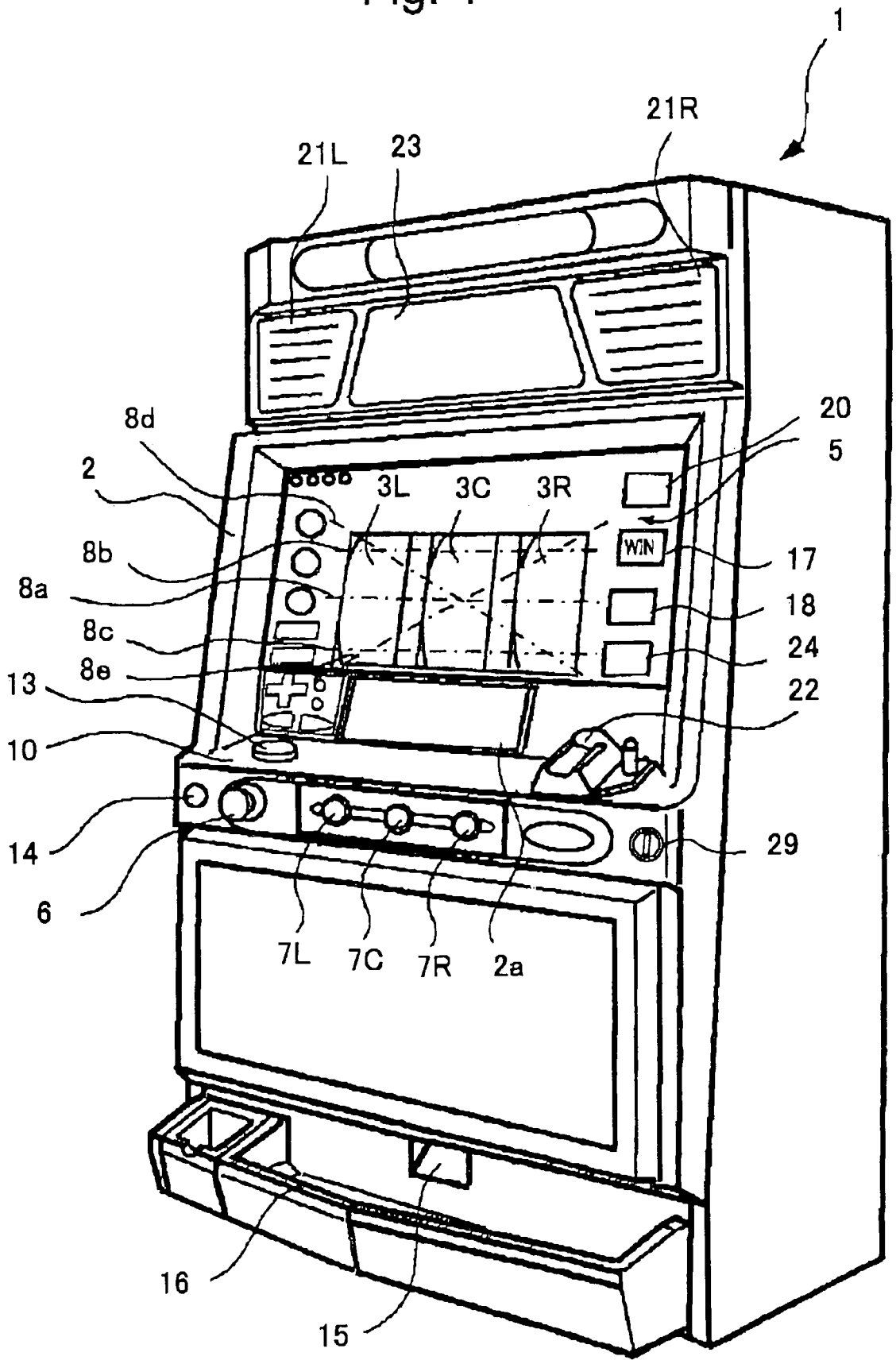
FIG. 1 is a perspective diagram illustrating an outward appearance of a slot machine according to an embodiment of the present invention.

According to the present invention, a gaming machine comprises: variable display means for variably displaying a plurality of patterns; front side display means, which is arranged in front of said variable display means, through which the patterns of variable display means can be seen; internal-win-combination determination means for determining an internal-win-combination; a plurality of operation means for stopping the variable display of said variable display means; stop control means for stopping and controlling a variable display operation of said variable display means based on the result of determination of said internal-win-combination determination means and an operation of said operation means; and game media disbursement means for disbursing game media when a stop mode of the variable display means stopped by said stop control means is a predetermined stop mode, wherein said front side display means is configured so as to stack a plurality of panel-shaped displays.

That is, it comprises the variable display means which is composed of a plurality of rotation reels on which the patterns are formed, and the front side display means, which is arranged in front of that, through which said patterns can be seen, and which makes possible certain information displays containing images, an alternative lamp or the like, and this front side display means is configured so as to stack, for example, two sheets of a panel-shaped display, thereby, if the same image is displayed on the same location of two sheets of the panel-shaped display, respectively, the images are overlapped and can be displayed more clearly, on the other hand, if another image is displayed on one panel-shaped display, both images are displayed so as to be synthesized and an illusionary display can be obtained. Thus, a clearer display, occasionally, more varied displays can be attained by stacking the plurality of panel-shaped displays used for the display.

A liquid crystal panel and an EL (electroluminescence) panel can be used suitably as the above-mentioned panel-shaped display.

When, herein, it is assumed that the liquid crystal panel is used as the panel-shaped display, the hollow portion, which can expose the patterns of the variable display means, can be formed on the above-mentioned variable display means, namely, the liquid crystal panel arranged at the rotation reel side.

According to such configuration, since the patterns of the rotation reels can be seen through one sheet of liquid crystal panel from the player side, the patterns of the reels are continually displayed relatively clearly even when the images are displayed using two sheets of liquid crystal panel.

In this case, the hole shape and its size of the hollow portion can be suitably formed. For example, it may be formed as one large-sized rectangular shape hole so that all three rotation reels can be viewed as whole, it may also be formed as three strip-shaped holes so that each of the three rotation reels can be viewed, respectively, or since three patterns are usually visible by one rotation reel, it may be formed as nine holes having a relatively small rectangular shape so that each pattern can be viewed, individually.

Thus, according to the present invention, the patterns of the variable display means which are composed of the rotation reels and the performance images displayed on the front side display means which are composed of a double-panel-shaped display arranged in front of both rotation reels can be clearly displayed.

Hereafter, referring to drawings, the gaming machine in accordance with this preferred embodiment will be described more specifically.

Figure 2:
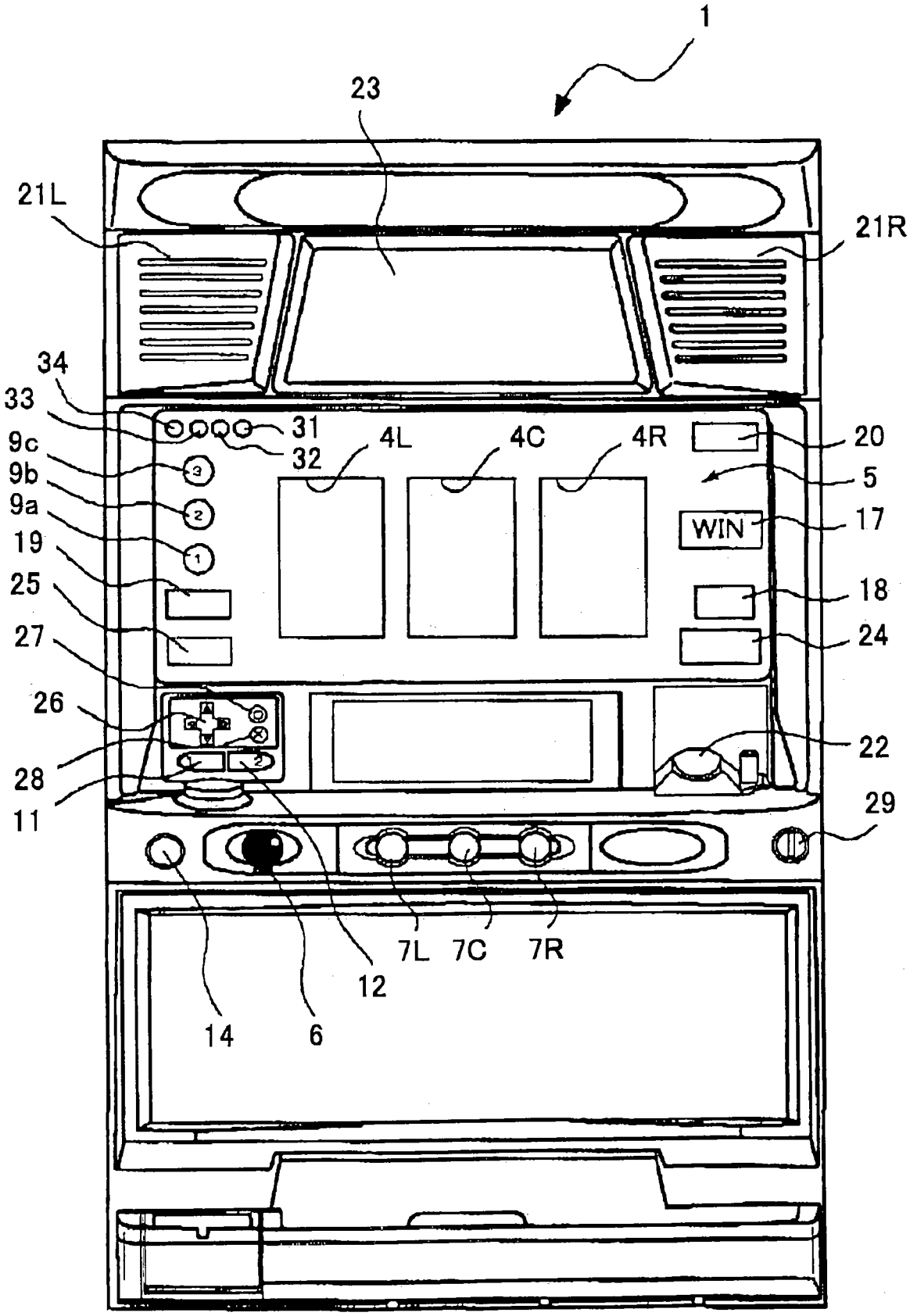
FIG. 2 is a front view illustrating an outward appearance of a slot machine according to an embodiment of the present invention.

FIG. 1 is a perspective diagram illustrating an outward appearance of a gaming machine 1 of one embodiment in accordance with the present invention; similarly, FIG. 2 is a front view of the gaming machine 1.

The gaming machine 1 is the so-called "pachislo machine" equipped with three rotation reels which variably display patterns, although it is possible to play using game media, such as a coin, a medal, a token, or a card which stores information on the game value granted or having been granted to a player, hereinafter, a description is given for the case of using a medal.

A panel display section 5 which is composed of the liquid crystal display as the front side display means used as a principal part of the present invention is arranged in the front of a cabinet 2 which forms the whole gaming machine 1.

Moreover, three rotation reels 3L, 3C and 3R, on each perimeter plane of which the pattern sequence configured by a plurality of pattern types is drawn, are rotatably arranged in one lateral line inside the cabinet 2 and form the variable display means. The patterns of each reel can be observed through the display windows 4L, 4C, and 4R which can be seen through said panel display section 5. Each reel rotates at a fixed-speed (for example, 80 revolutions per minute).

Although the configuration of the panel display section 5 used as the principal part will be explained in full detail later, a display screen 5*a*, which is composed of the liquid crystal, and through which said rotation reels 3L, 3C, and 3R can be seen, is arranged throughout the whole surface, when seen from the player side, elements that are described below appear in the external appearance.

That is, the lengthwise rectangular display windows 4L, 4C, and 4R are visible in the central part of the display screen 5*a*, and a center line 8*a*, a top line 8*b*, and a bottom line 8*c* in the horizontal direction, and a cross down line 8*d* and a cross up line. 8*e* in the slant direction are visible as prize-winning lines in these display windows 4L, 4C, and 4R. Among these prize-winning lines, one, three, or five lines are validated, respectively, by operating a 1-BET switch 11, a 2-BET switch 12, and a max-BET switch 13 which will be described later, or by loading the medal(s) into a medal slot 22. Which prize-winning line is validated is indicated by lighting of the line, and lighting of BET lamps 9*a*, 9*b*, and 9*c*, which will be described as follows.

That is, the 1-BET lamp 9*a*, the 2-BET lamp 9*b*, the max-BET lamp 9*c*, and a game medal deposited number display section 19 are arranged in the left side of the display windows 4L, 4C, and 4R. In order to play one game, the 1-BET lamp 9*c*, the 2-BET lamp 9*b*, and the max-BET lamp 9*c* are lit according to the number of medals bet for one game (hereinafter referred to as "BET number"). Here, in this embodiment, one game is terminated when all reels stop, or when the game media are disbursed if the game media are to be disbursed. The 1-BET lamp 9*a* is lit when the BET number is "1" and one prize-winning line is validated. The 2-BET lamp 9*b* is lit when the BET number is "2" and when three prize-winning lines are validated. The max-BET lamp 9*c* is lit when the BET number is "3" and all (5) prize-winning lines are validated. A game start display lamp 25 arranged under the BET lamps 9*c*, 9*b*, and 9*c* is also lit when at least one line is validated. Moreover, the game medal deposited number display section 19 displays the number of medals currently deposited.

A WIN lamp 17, a disbursement display section 18, and a game medal load lamp 24 are arranged in the right side of the display windows 4L, 4C, and 4R. The WIN lamp 17 is lit with a predetermined probability when either the BB or the RB is achieved by the internal-win, and is also lit when the prize-winning of the BB or the RB is achieved. The disbursement display section 18 comprises a 7-segment LED, and displays the number of medals disbursed when the prize-winning is achieved. When loading of the game medal is made acceptable, the game medal load lamp 24 blinks.

A bonus operation frequency display section 20 is arranged in the upper right-side of the display screen 5*a*. The bonus operation frequency display section 20 displays the number of available RB games, available RB game prize-winning frequency and the like, which will be described later.

In the upper left-side location of the display screen 5*a*, a game stop indicator 31, a re-game indicator 32, an RB operation indicator 33, and a BB operation indicator 34 are arranged in one lateral line. The game stop indicator 31 is lit when the time from previous rotation of a rotatable drum to the present rotation of the rotatable drum is less than a predetermined period of time (in this embodiment 4.1 seconds). When the re-game runs, the re-game indicator 32 is lit. The RB operation indicator 33 is lit during the RB operation, and the BB operation indicator 34 is lit during the BB operation.

In addition, when a "bell's insignificant winning-combination" is achieved by the internal-win during the "stop operation assistance period" described later, a "stop sequence" required for realizing the prize-winning achievement is displayed on the display screen 5*a*, which has been described above.

A pedestal section 10 of the level surface is formed under the display windows 4L, 4C, and 4R which can be seen through the display screen 5*a*, and a marker section 2*a*, on which information about the gaming machine 1 or the like is displayed, is arranged between the pedestal section 10 and said display windows 4L, 4C, and 4R.

In addition, the medal slot 22 is arranged in the right side of marker section 2*a*, and the 1-BET switch 11, the 2-BET switch 12, and the max-BET switch 13 are arranged in the lower left location of the marker section 2*a*. In addition, + (cross-joint) button 26, o button 27, and x button 28 are arranged in the upper left location of the marker section 2*a*.

By one push operation of the 1-BET switch 11, one of the credited medals can be bet on the game, by one push operation of the 2-BET switch 12, two of the credited medals can be bet on the game, and by one push operation of the max-BET switch 13, the maximum number of medals which can be bet in one game can be bet. By operating these BET switches, a predetermined prize-winning line is validated as mentioned above.

Then, a switching of the display screen 5*a* and the input can be performed by operating the + (cross-joint) button 26, the o button 27, and the x button 28.

A deposited medal pay switch 14 which switches, by a push-button operation, the credit/disbursement of the medal that the player has won in the game, is arranged in the left side of the front section of the pedestal section 10. The medal is disbursed from the game medal disbursement slot 15 of the front lower part by switching this deposited medal pay switch 14, the disbursed medal(s) are deposited in a game medal receiving section 16. On the right side of the deposited medal pay switch 14, a start lever 6, which rotates the above mentioned reels by the player's operation and starts the variable display of the patterns (the game is started) within the display windows 4L, 4C, and 4R, is rotatably arranged within a range of a predetermined angle.

A door opening/closing and game-over release device 29 is arranged in the right side of the front section of the pedestal section 10, and this door opening/closing and game-over release device 29 opens and closes a front door by turning to the right and releases the game-over by turning to the left using a predetermined key.

Loud speakers 21L and 21R are arranged in the upper right and left of the cabinet 2, and between these two loudspeakers 21L and 21R, a distribution table panel 23, which displays the prize-winning pattern combination and the number of medals as a distribution or the like, is arranged. In the center of the front section of the pedestal section 10 and in the lower location of the marker section 2*a*, three stop buttons 7L, 7C, and 7R for stopping the rotation of three rotation reels 3L, 3C, and 3R, are, respectively, arranged.

In the gaming machine 1 in the above-mentioned configuration, the present invention is characterized in that the panel display section 5, which is the front side display means, is configured so that a plurality of panel-shaped displays may be stacked, and the configuration of the panel display section 5 used as the principal part of the present invention will be explained hereinafter. The following description will be given, on the assumption that the panel-shaped display is a liquid crystal panel, and the plurality of liquid crystal panels 501 and 502 mentioned above are a first liquid crystal panel 501 and a second liquid crystal panel 502, respectively.

Figure 35:
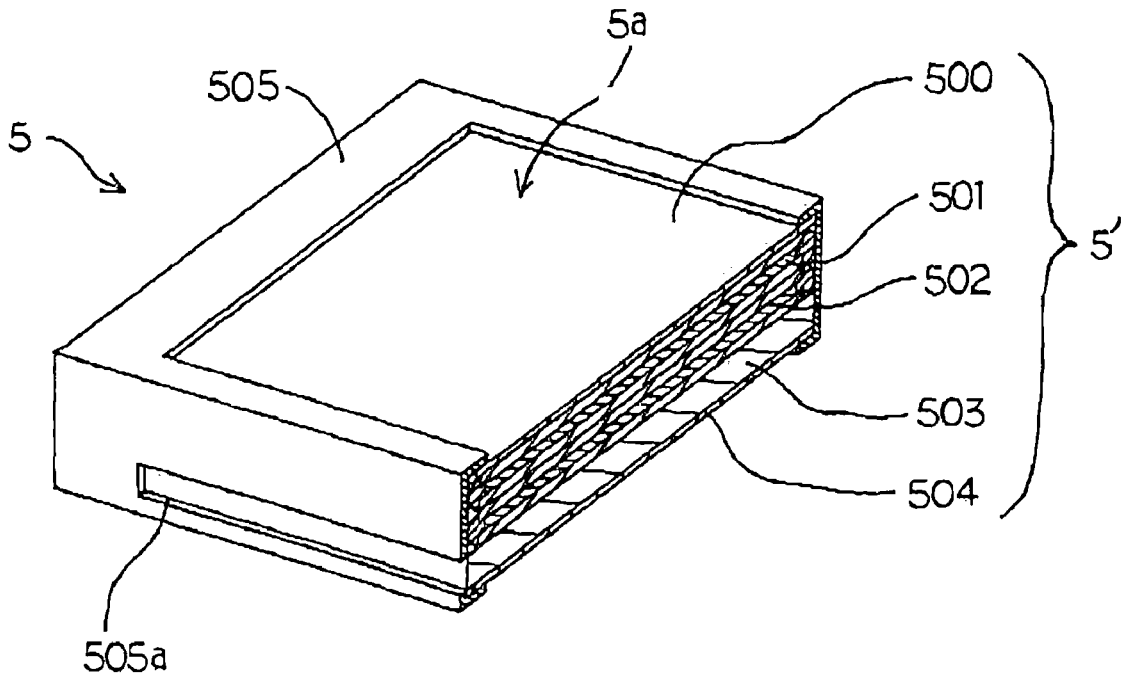
FIG. 35 is an explanatory drawing of a panel display section.

As illustrated in FIG. 35, the panel display section 5 according to this preferred embodiment comprises a multilayer panel body 5', which is held being pressed by a frame 505.

Figure 36:
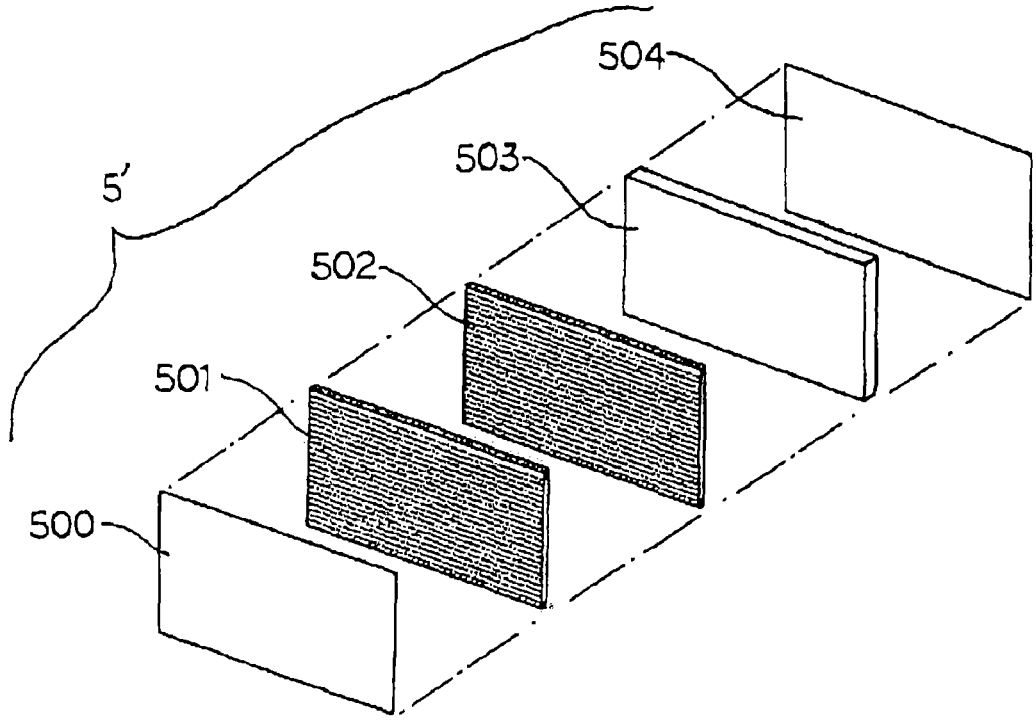
FIG. 36 is an exploded perspective diagram of a panel display section.

That is, as illustrated in FIG. 35 and FIG. 36, the multilayer panel body 5' has a multilayer structure, comprising, from the outermost side (the foremost side): a transparent cover glass 500, the first liquid crystal panel 501 and the second liquid crystal panel 502, which substantially configure said front side display means; an acrylic plate 503 having a predetermined thickness, which configures a part of a back light structure; and a reflecting plate 504, which is composed of a plastic film pasted on the rear side of this acrylic plate 503. It is preferable to perform an convexoconcave treatment on the surface of the reflecting plate 504 so that light may reflect irregularly and diffuse. In addition, a transparent acrylic plate may be used instead of said cover glass 500.

Figure 37:
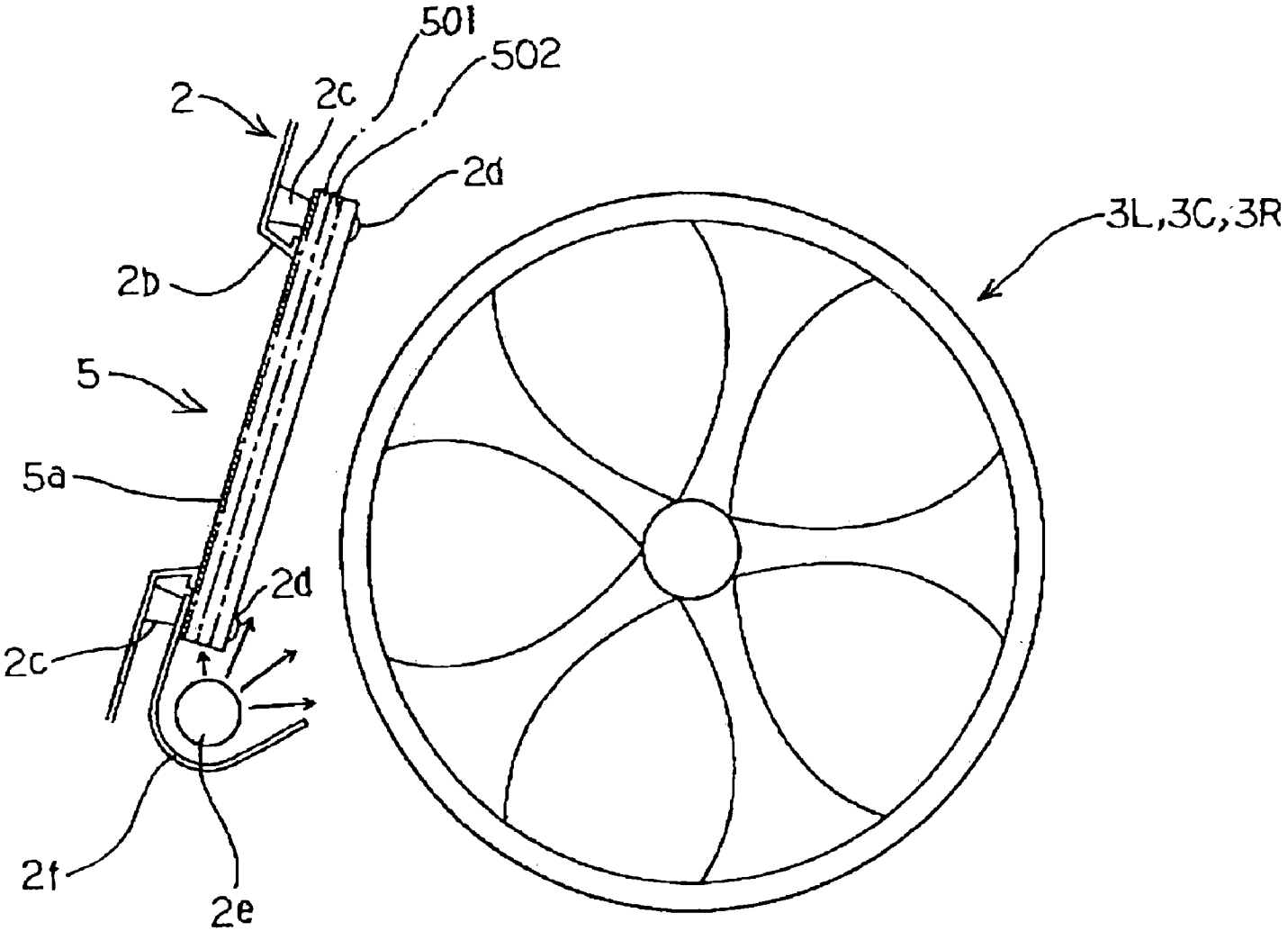
FIG. 37 is an explanatory drawing illustrating an arrangement status of a panel display section.

Then, as illustrated in FIG. 37, the multilayer panel body 5' configured as above is attached to a front opening 2*b* of the cabinet 2 so as to face from the back side, and the portion exposed from the cabinet 2 forms the display screen 5*a*. In addition, reference numerals 2*c* and 2*c'* are bosses for fixing top/bottom panels, and reference numeral 2*d* is a fixing screw.

A cold cathode tube 2*e*, which functions as a back light of said first and second liquid crystal panels 501 and 502, and also enables the patterns of the rotation reels 3L, 3C, and 3R to be irradiated, is arranged under the multilayer panel body 5'.

That is, said cold cathode tube 2*e* is closely arranged to the bottom end of said acrylic plate 504, and also functions as the back light of the first liquid crystal panel 501 and the second liquid crystal panel 502 by forming a notch 505*a* for use in light transmission in said frame 505, and passing through the light from the edge of the acrylic plate 504 to the whole and diffusing it to the front by said reflecting plate 504.

In addition, a part of the light of the cold cathode tube 2*e* irradiates the rotation reels 3L, 3C, and 3R, which are rearwardly arranged in the multilayer panel body 5'. In the view, reference numeral 2*f* is a reflective cover arranged so as to contain the cold cathode tube 2*e*, is bendingly formed into a U letter shape in the cross sectional view, and is fastened with the panel body 5' to the boss 2*c'* used for fixing the bottom panel.

Thus, in this preferred embodiment, if the first liquid crystal panel 501 and the second liquid crystal panel 502 are stackingly arranged and the same image is displayed on the same location of both the liquid crystal panels 501 and 502, respectively, the images are overlapped and can be displayed more clearly; on the other hand if different images are displayed on one liquid crystal panel, both images are displayed so as to be synthesized and an illusionary display will be obtained. That is, a character image, text information as well as the prize-winning line, lamps, and display sections described above can be displayed on the first liquid crystal panel 501, and background images or the like can also be displayed on the second liquid crystal panel 502. Then, while keeping the image on one liquid crystal panel 501 (502) as it is, the image on the other liquid crystal panel 502 (501) can be varied, thereby the various image displays including the illusionary display can be obtained.

Thus, by stacking two liquid crystal panels 501 and 502, and displaying the images, a clearer display and occasionally greater various displays can be obtained, thereby making it possible to increase amusement of the game for the player, and also to display the information to be strongly impressive.

Moreover, if a range corresponding to the rotation reels 3L, 3C, and 3R in the second liquid crystal panel 502 is made to be a see-through condition without displaying the image, since each pattern of the rotation reels 3L, 3C, and 3R can fully be seen through the first liquid crystal panel 501 which is also made into a see-through condition, the variation of the rotation reels 3L, 3C, and 3R can also be continually visually identified.

Figure 38:
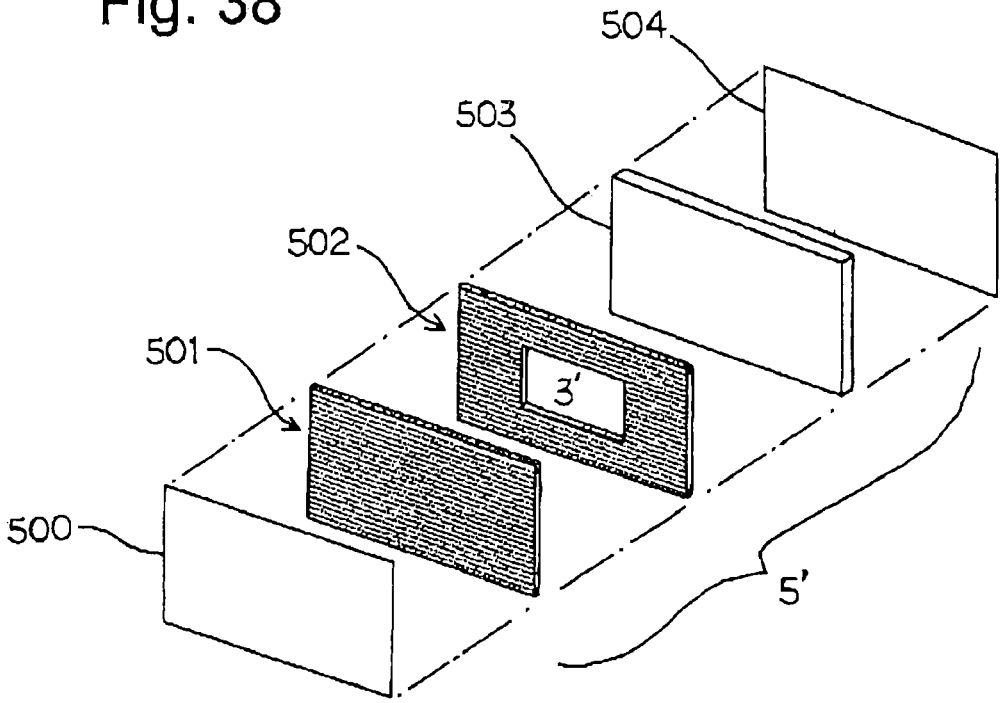
FIG. 38 is an explanatory drawing of a panel display section according to another preferred embodiment.

Moreover, as illustrated in FIG. 38, a hollow portion 3', which can expose the patterns of the rotation reels 3L, 3C, and 3R, can be formed in the second liquid crystal panel 502 which is arranged on the side of the rotation reels 3L, 3C, and 3R. Here, the shape of hollow portion 3, is a large-sized rectangular shape where all three whole rotation reels 3L, 3C, and 3R can be viewed as a whole simultaneously.

According to such configuration, since the patterns of the rotation reels 3L, 3C, and 3R can be seen through the first liquid crystal panel 501 from the player side, the patterns of the rotation reels 3L, 3C, and 3R are always displayed relatively clearly even when the images are displayed using two liquid crystal panels 501 and 502.

Figure 39:
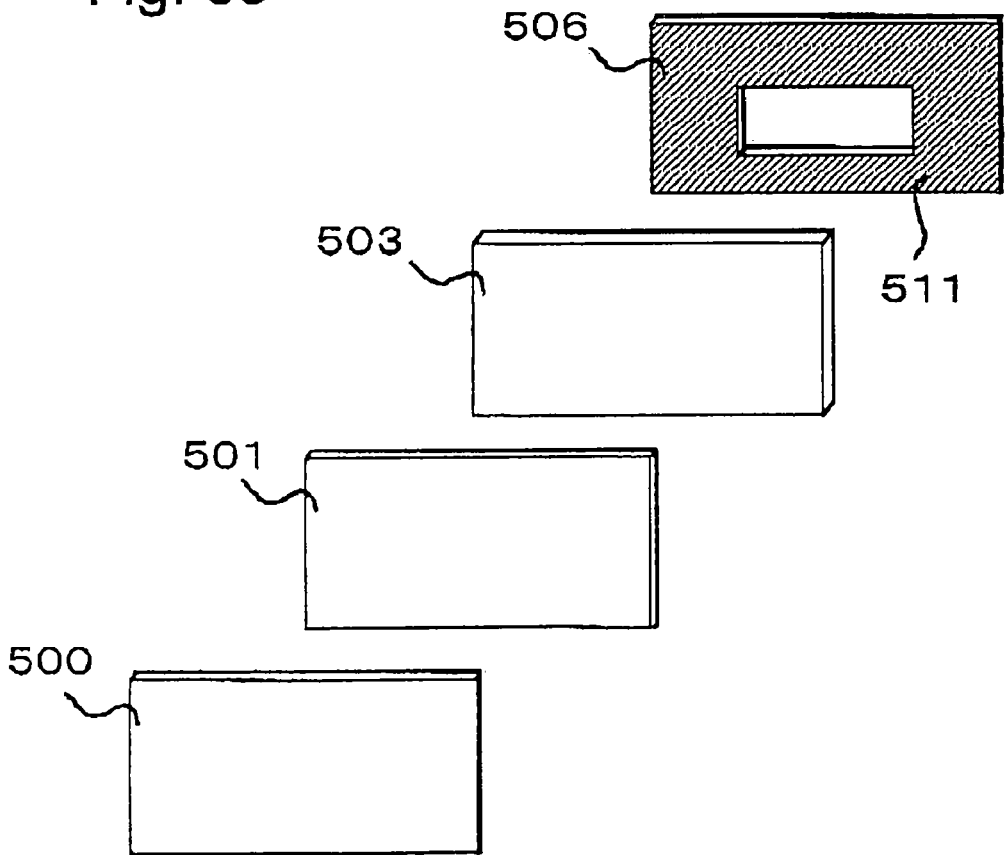
FIG. 39 is an explanatory drawing of a panel display section according to another preferred embodiment.

Moreover, as illustrated in FIG. 39, the multilayer panel body 5' may be formed using a reflecting plate 506 which is composed of an opaque member instead of the second liquid crystal panel 502. Since the hollow portion 3' is arranged in the central part of the reflecting plate 506 like the second liquid crystal panel 502 of FIG. 38 so that the patterns of the rotation reels 3L, 3C, and 3R can be visually identified, when the first liquid crystal panel 501 is controlled to be transparent, the patterns of the rotation reels 3L, 3C, and 3R can be visually identified clearly, while in a non-see-through area except the hollow portion 3', the inside of the gaming machine including the rotation reels 3L, 3C and 3R cannot be visually identified.

Figure 40:
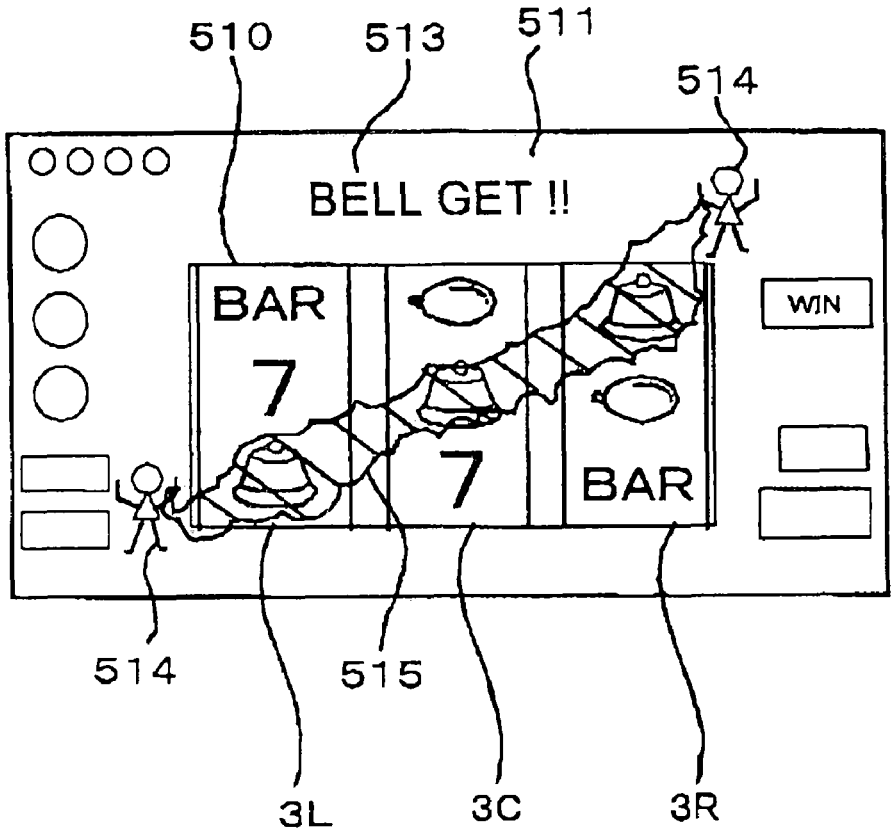
FIG. 40 is an explanatory drawing illustrating an example of performance in this panel display section.

FIG. 40 is a view illustrating an example of performance carried out when prize-winning occurs. On the reels 3L, 3C, and 3R, the prize-winning of a bell can be confirmed in the upward slant to the right through a transparent area 510, and an electric shock image 515, which is a prize-winning performance, is displayed along with the prize-winning line of the bell. In a non-transparent area 511, a message 513, which informs that the bell has won a prize, is displayed, and the image where witch characters 514 are generating the electric shock image 515 is displayed. Although the performance of both images in both display areas are controlled and displayed on the first liquid crystal panels 501, since there is no interference of light from the inside of the gaming machine within the non-transparent area 511, it is possible to display clearer images. Although the images become blurred within the transparent area 510 because of light from the inside of the gaming machine, it is possible to carry out a unique visual-sense performance since they are overlapped to the reel patterns.

As described above, the transparent area 510 where the game information, such as reel patterns, arranged in the inside of the gaming machine can be seen through the first liquid crystal panel 501, and the non-transparent area 511 including an area where the second liquid crystal panel 502 is controlled not to be transparent or an area where the reflecting plate 506 is arranged, and where the information inside the gaming machine cannot be seen through, are arranged, whereby it becomes possible to control various performances, in which the feature of the display area is efficiently demonstrated according to the game situation, respectively.

The transparent area 510 and the non-transparent area 511 may not be configured to completely allow the passage of the light, or not to completely allow the passage of the light, respectively, and even the transparent area 510 may block the light slightly, or even the non-transparent area 511 may pass the light slightly, depending on the mode of performance control.

Figure 41:
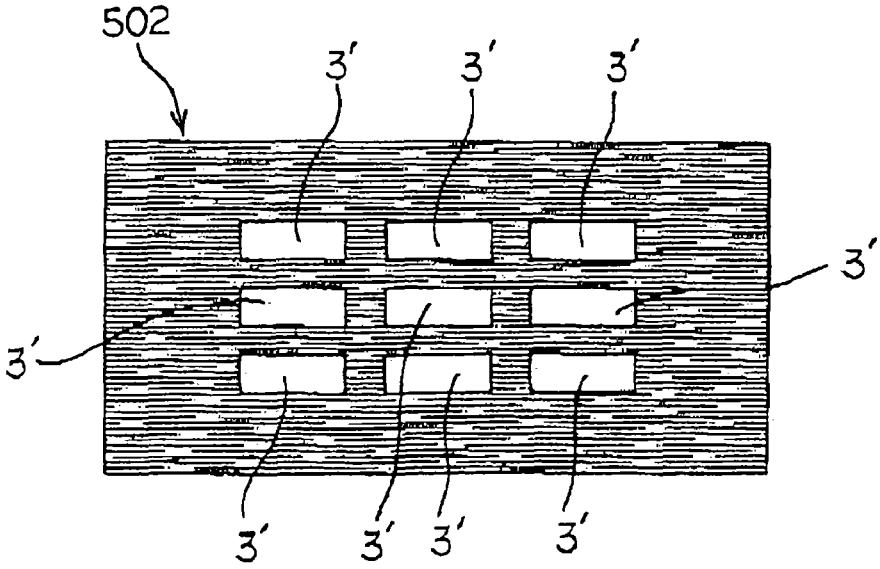
FIG. 41 is an explanatory drawing of a modification of a second liquid crystal panel.
Figure 42:
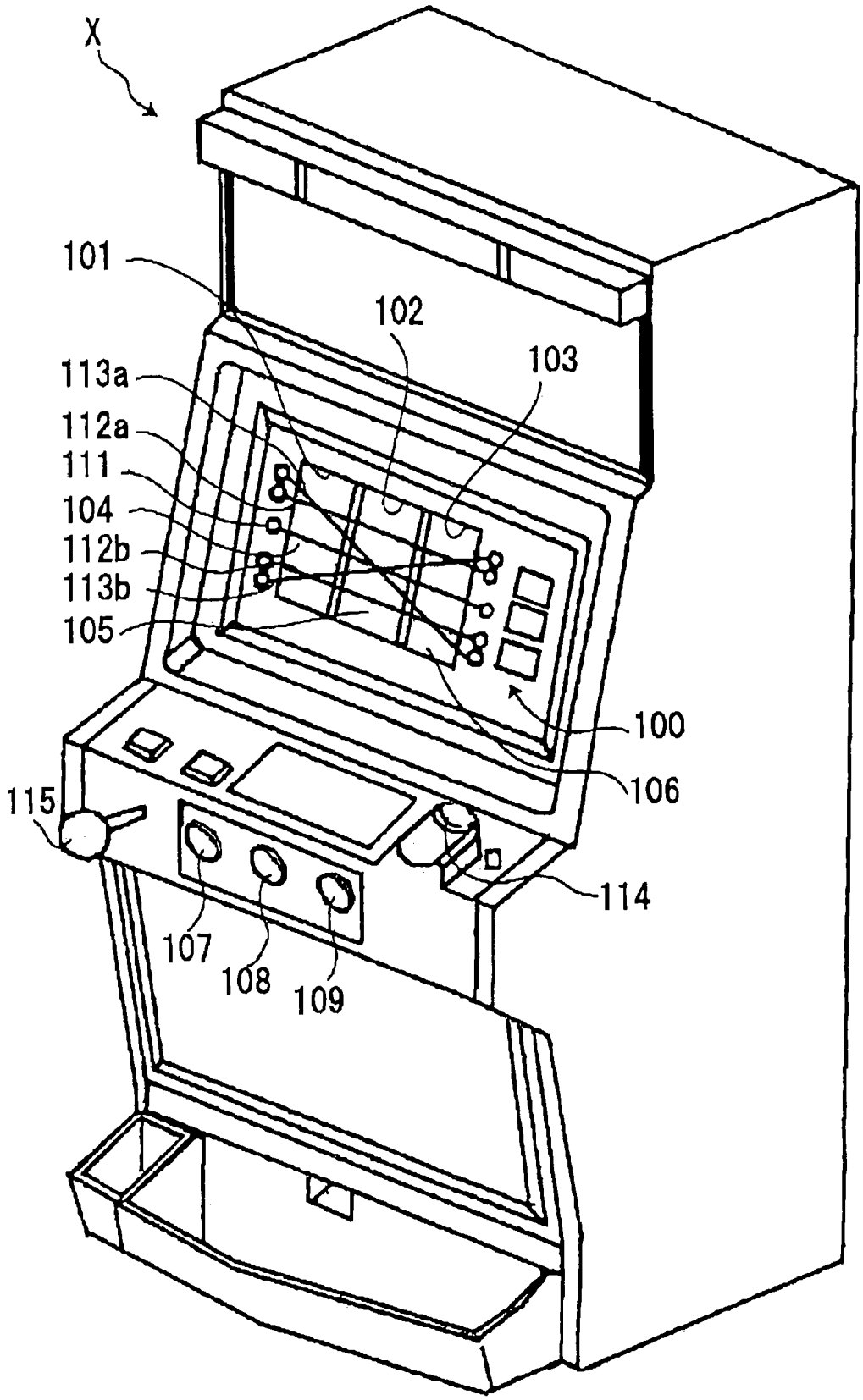
FIG. 42 is an explanatory drawing illustrating an example of a conventional gaming machine.

In addition, the hole shape and its size of the hollow portion 3' can be suitably set up, for example, as illustrated in FIG. 41, it may be formed in relatively small nine rectangular shapes where each pattern of the rotation reels 3L, 3C, and 3R can be viewed, respectively.

In the above-mentioned configuration, although it has been described using the first and the second liquid crystal panels 501 and 502 as the front side display means, the EL (electroluminescence) panel can also be used for both of them instead. In either case, when such an electronic display is used, thin and compact display means can be configured; moreover, moving images or the like can be displayed, thereby making the display of various kinds of information possible.

Here, the operation of three stop buttons 7L, 7C, and 7R for stopping the rotation of three rotation reels 3L, 3C and 3R, respectively, which rotate and stop by operating a start lever 6 is described.

In this embodiment, a stop operation which is performed while all reels 3L, 3C, and 3R are rotating is called a "first stop operation," a stop operation performed thereafter is called a "second stop operation," and a stop operation performed after the "second stop operation" is called a "third stop operation." In addition, to operate the left stop button 7L as the "first stop operation" is called a "forward push." To operate the central stop button 7C as the "first stop operation" is called a "center push." To operate the right stop button 7R as the "first stop operation" is called a "reverse push."

Since three stop buttons 7L, 7C, and 7R are arranged in this gaming machine 1, there are "six kinds" of these operation sequences. These operational sequences are then, distinguished as follows. The left stop button 7L is denoted as "LEFT," the central stop button 7C is denoted as "CENTER," and the right stop button 7R is denoted as "RIGHT." Then, when a stop sequence is shown, assume that the abbreviation for each of stop buttons 7L, 7C, and 7R is arranged from the left in turn according to the stop operation. For example, when the left stop button 7L is operated as the "first stop operation," the central stop button 7C as the "second stop operation," and the right stop button 7R as the "third stop operation," then the stop sequence is shown as "LEFT CENTER RIGHT." Furthermore, there are "six kinds" of stop sequences in this embodiment, namely, "LEFT CENTER RIGHT," "LEFT RIGHT CENTER," "CENTER LEFT RIGHT," "CENTER RIGHT LEFT," "RIGHT LEFT CENTER" and "RIGHT CENTER LEFT."

FIG. 5 illustrates a pattern sequence where twenty one patterns having a plurality of kinds of patterns shown on each of the reels 3L, 3C, and 3R are arranged. The code number of "00"-"20" is given to each pattern, and is stored in a ROM 32 as a data table as described later. On each of reels 3L, 3C, and 3R, the pattern sequence which comprises a pattern of "blue7," "red7," "bar," "bell," "plum," "Replay," and "cherry" is shown. Each of reels 3L, 3C, and 3R is rotated so that the pattern sequence may move in the direction of an arrow.

A table illustrated in FIG. 6 illustrates the prize-winning-combination and disbursed number corresponding to a prize-winning pattern combination in each game mode.

The game mode is classified into three modes of a general game mode (the mode under this is also expressed as "under general game"), a general game mode under the BB (the mode under this is also expressed as "on BB") and an RB game mode (the mode under this is also expressed as "on RB"). Normally, the mode under the, general game mode is expressed as "under general game," the mode on the "general game mode in the BB" is expressed as "on BB," and the mode on the RB game mode is expressed as "on RB."

Moreover, although there may be a case where the general game mode is further classified by whether or not the internal-win has achieved the BB or the RB, since the prize-winning-combination, which may achieve the internal-win, is the same, the classification in this table is grouped into 3 modes in the table.

The type of prize-winning-combination which may achieve the internal-win is determined by the so-called probability lottery table (the probability lottery table will be described later), and this probability lottery table is arranged for every game mode. That is, in the game of the same game mode, the type of winning-combination which may achieve the internal-win becomes the same.

In the general game mode, as illustrated in FIG. 6, when the "blue7-blue7-blue7" or the "red7-red7-red7" lines up along an effective line, prize-winning of the BB is achieved, and as a result of this, 15 medals are disbursed and the game mode of the following game enters the "BB game mode."

The "RB game mode" occurs when the combination of patterns lined up along the effective line in the "general game mode" is "bar-bar-bar," or when the combination of patterns lined up along the effective line in the "general game mode in BB" is "Replay-Replay-Replay" (so-called "JAC IN"). The 15 medals are disbursed at this time. The "RB game mode" is a game mode where it is easy to achieve a predetermined combination of the patterns "Replay-Replay-Replay" and to win the bonus which gives the player 15 medals by betting one medal. In one time of the "RB game mode," the maximum playable game frequency (this is called "playable RB game frequency") is 12 times. In addition, in this "RB game mode," the frequency of winning the prize (this is called "RB game prize-winning frequency") is equal to or less than 8 times. That is, this "RB game mode" is terminated when the frequency of the game reaches 12 times or the frequency of the prize-winning reaches 8 times. Then, after the "RB game mode" is terminated, it shifts to the general game mode.

One time of BB is terminated, when 30 games of the "general game mode in BB" are played, or after shifting to the "RB game model" is carried out 3 times and then the third RB is over. Then, after the BB game mode is terminated, it shifts to the general game mode.

In the general game mode, when the combination of patterns lined up along the effective line is "Replay-Replay-Replay," a prize-winning of a re-game is achieved. When the prize-winning of the re-game is achieved, since the number of medals identical to the number of medals having been loaded is loaded automatically, the player can perform the game, without losing the medals.

In the general game mode or the "general game mode in BE," when a combination of patterns "bell-bell-bell" is lined up along the effective line, a prize-winning of the "bell's insignificant winning-combination" is achieved. When the internal-win of the "bell's insignificant winning-combination" is achieved, whether the prize-winning is achieved or not is determined by a table number described later and the stop sequence of the stop buttons 7L, 7C, and 7R by the player specifically, only when the stop operation is performed by one stop sequence corresponding to the table number among "six kinds" of stop sequences, "bell-bell-bell" lines up along the effective line, and the prize-winning of the "bell's insignificant winning-combination" is achieved. When the stop operation is performed by either of "five kinds" of other stop sequences, the prize-winning of the "bell's insignificant winning-combination" is not achieved.

Moreover, under the general game mode and the "general game mode in BB" although it is possible to achieve the prize-winning of "plum's insignificant winning-combination," "cherry's insignificant winning-combination" or the like, the disbursed number is shown in the drawing.

Under the "general game mode," when the internal-win achieves the "bell's insignificant winning-combination," a period called the "stop operation assistance period (described later as AT)," to which the "stop sequence" that will achieve the prize-winning is informed, is set up. During this period, when the internal-win achieves the "bell's insignificant winning-combination," the player can certainly realize the prize-winning achievement.

Figure 7:
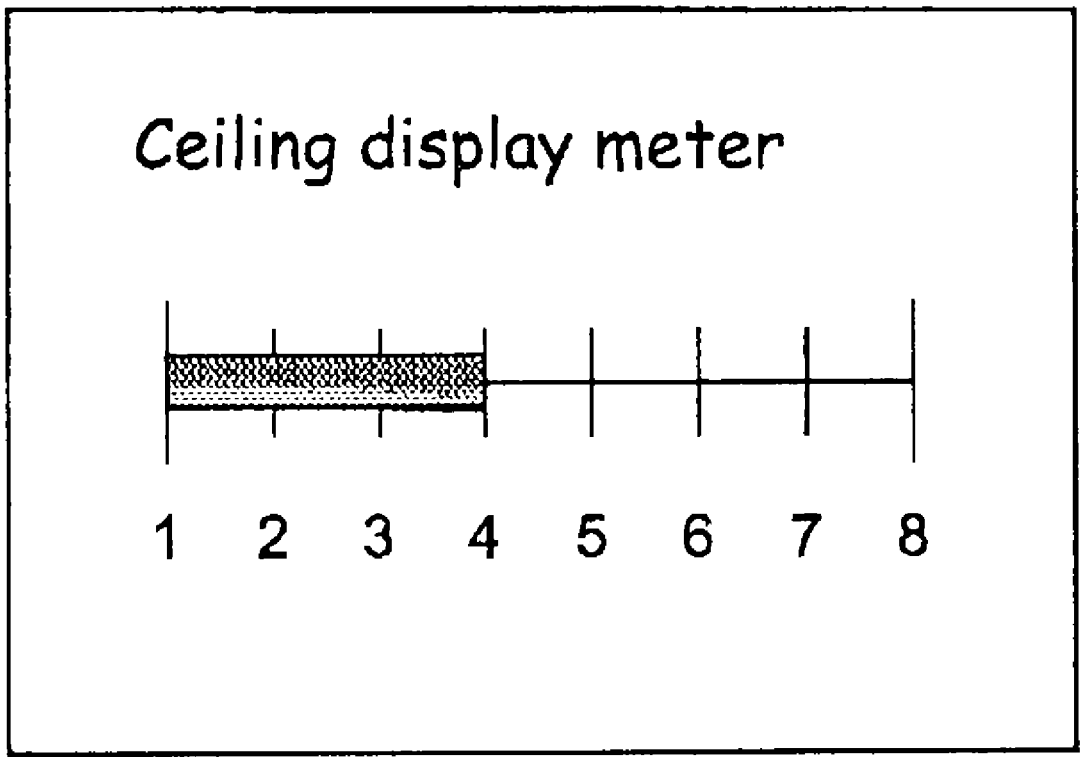
FIG. 7 is a view illustrating an example of a ceiling display meter.

FIG. 7 is a view for describing an example of a "ceiling display meter" which is a display means for displaying a process until remedial action occurs. The scale illustrated in the view shows a difference between the total number of medals used for the game and the total number of disbursed medals. That is, normally, since the number of used medals becomes larger than the number of disbursed medals, the scale of the meter increases until a bonus or the like is won. The scale of this meter begins with a scale of 1 when the BB is terminated, and the remedial action, so-called, ceiling is activated when the scale becomes 8.

Although such a process is displayed with the liquid crystal on the display screen 5*a* in this embodiment, by driving the second liquid crystal panel 502 and masking the backside of the scale portion at this time, the liquid crystal display can be visually identified extremely clearly.

Figure 8A:
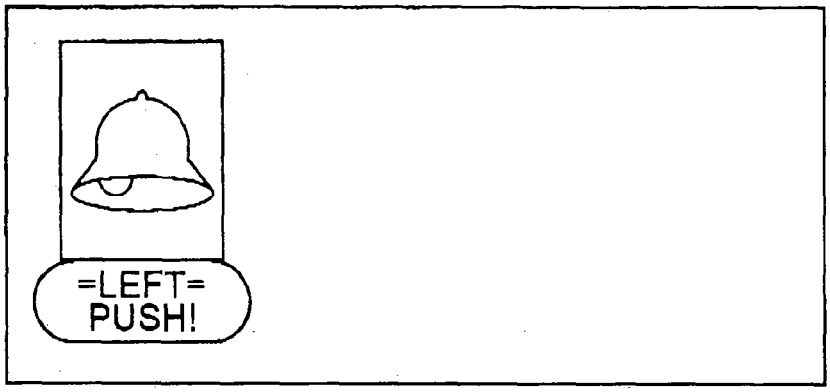
FIG. 8A is a view illustrating an example of an image which informs a left stop operation.
Figure 8B:
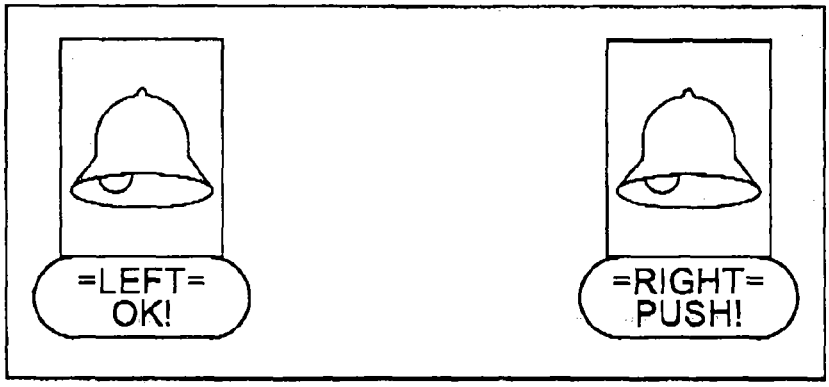
FIG. 8B is a view illustrating an example of an image which informs a right stop operation.
Figure 8C:
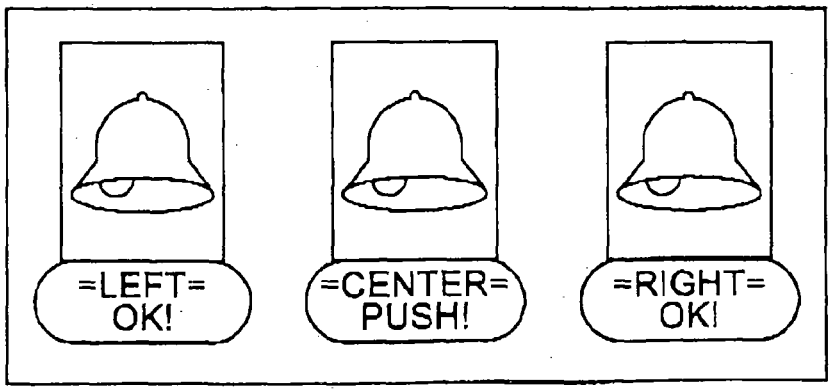
FIG. 8C is a view illustrating an example of an image which informs a center stop operation.
Figure 19:
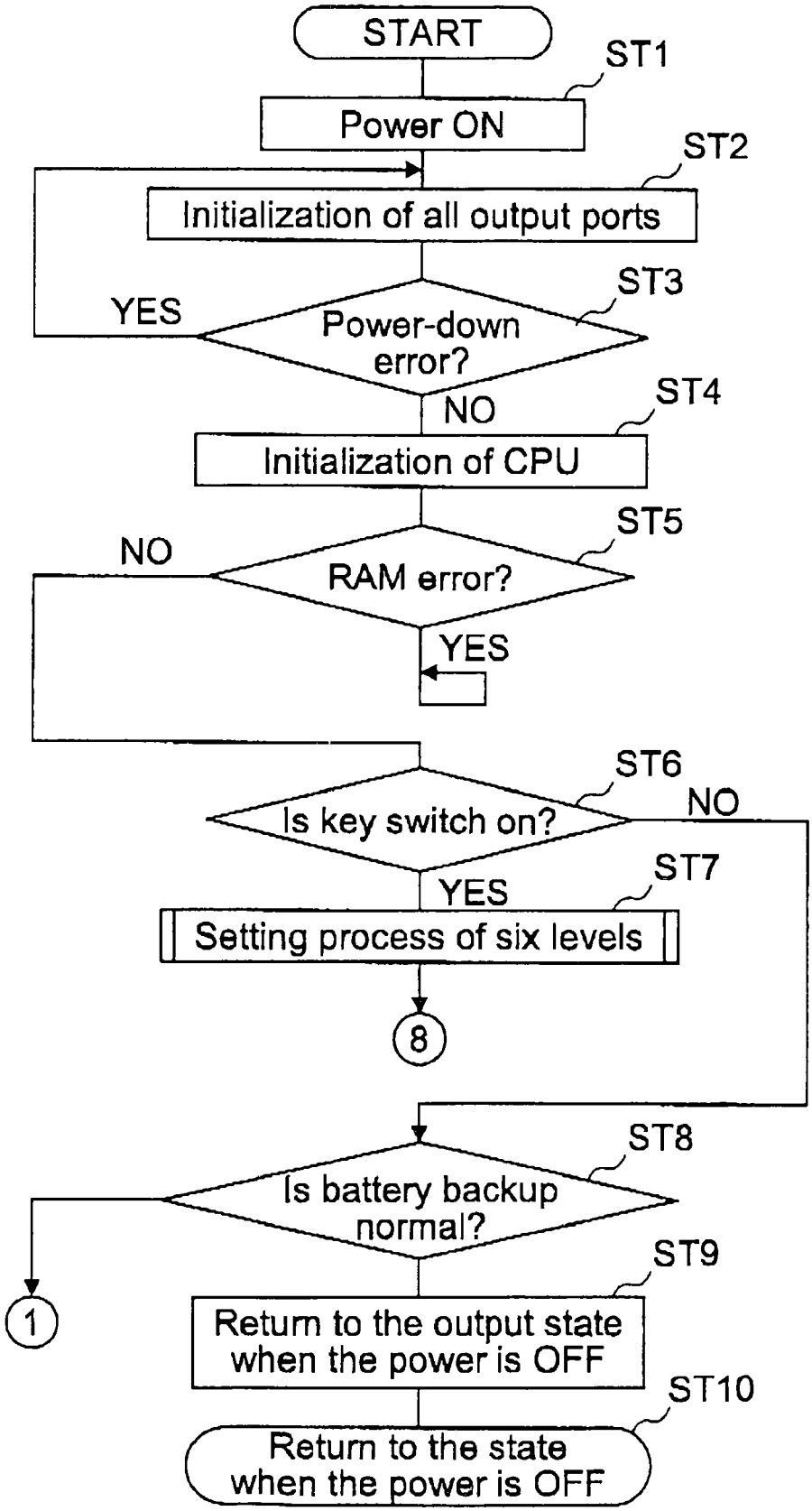
FIG. 19 is a flowchart illustrating a process of a main control circuit.
Figure 20:
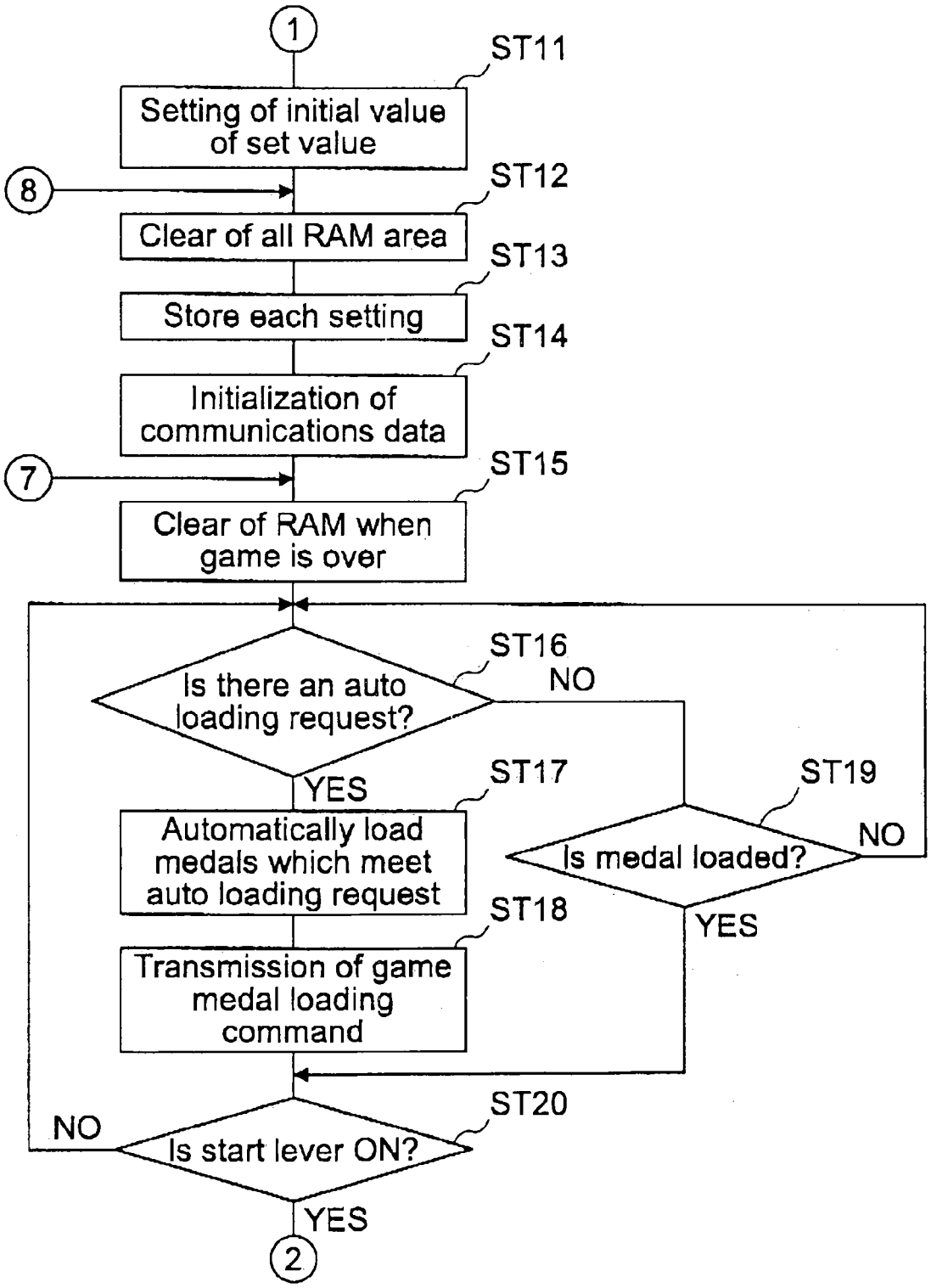
FIG. 20 is a flowchart illustrating a process of a main control circuit.
Figure 21:
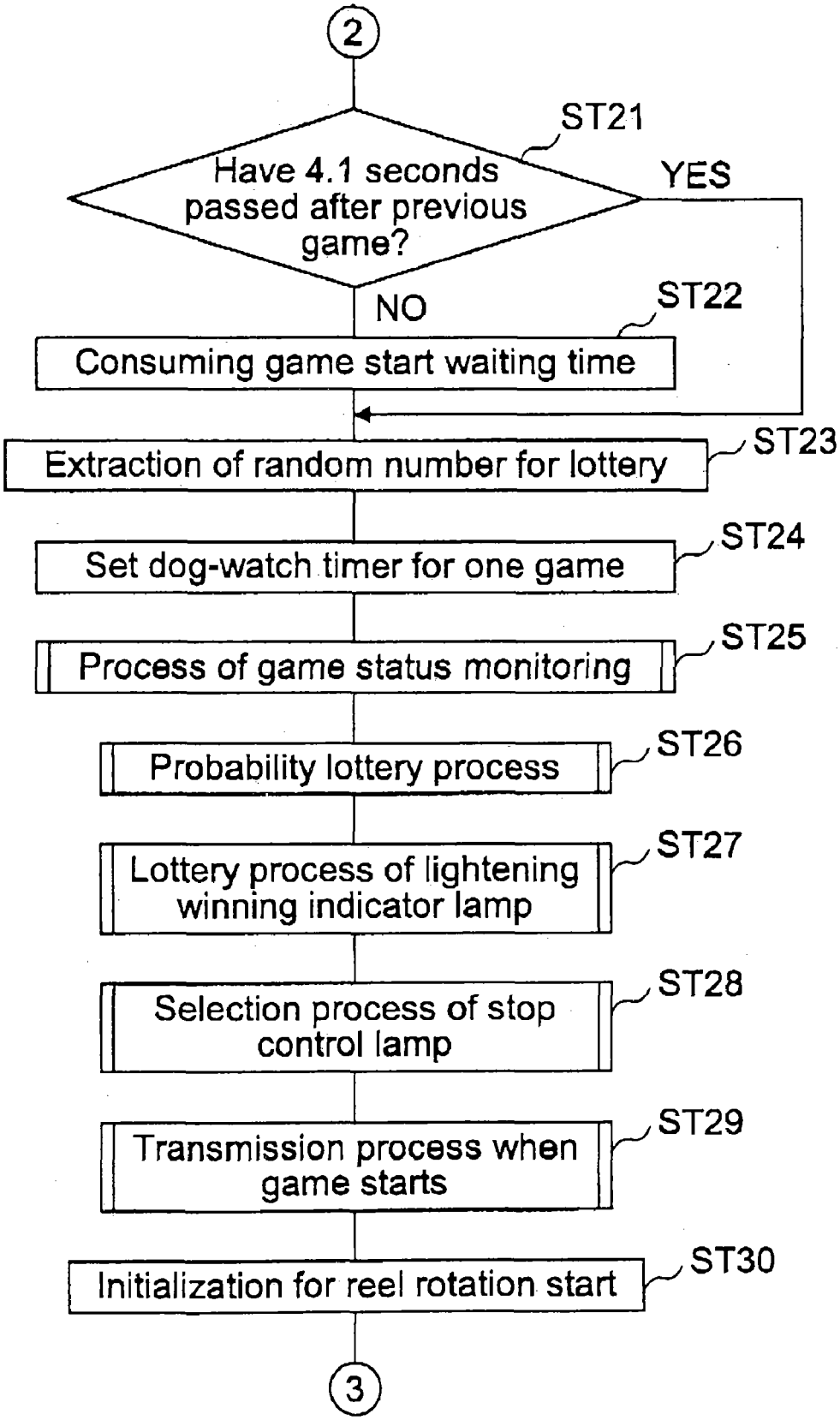
FIG. 21 is a flowchart illustrating a process of a main control circuit.
Figure 22:
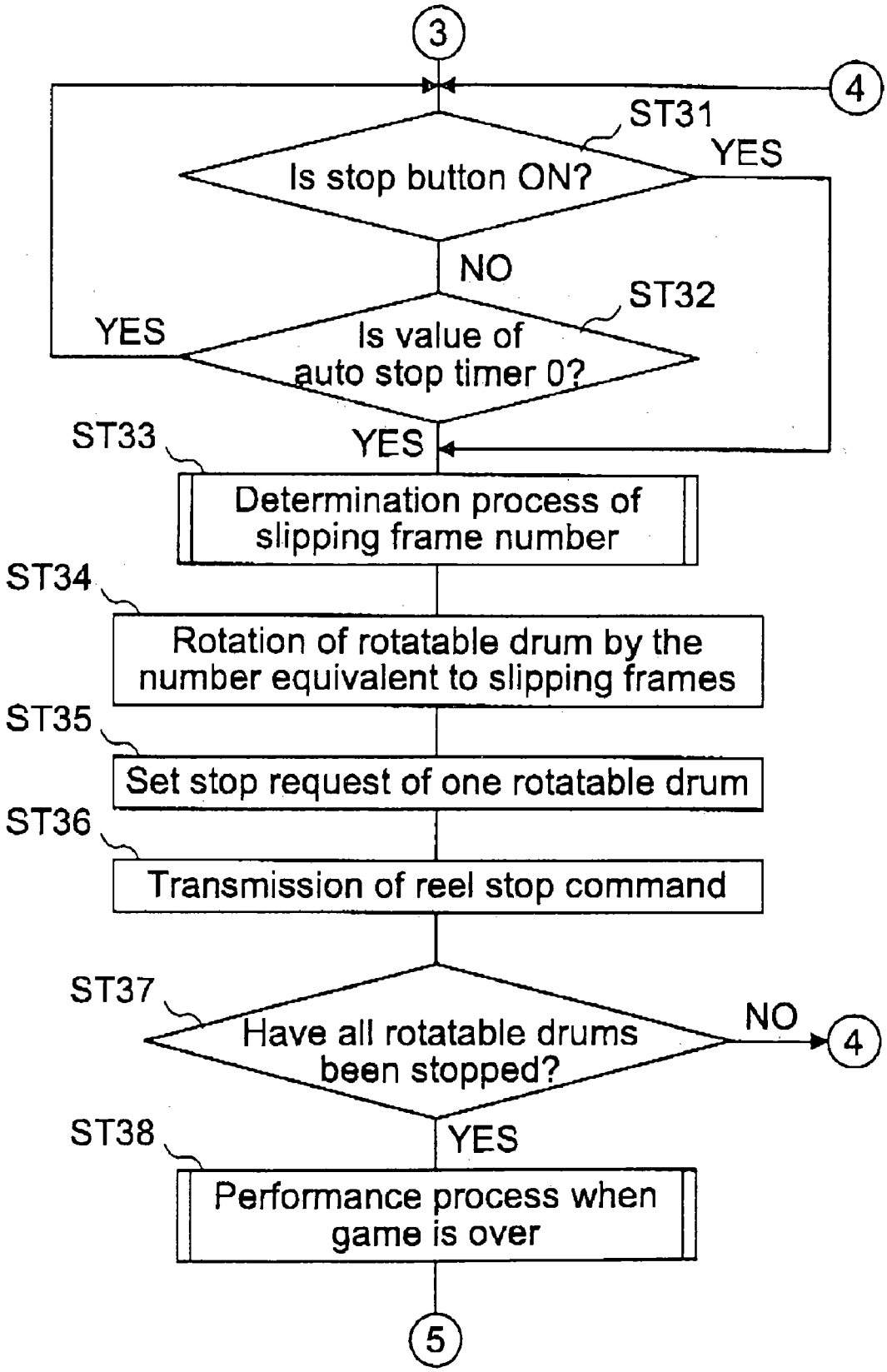
FIG. 22 is a flowchart illustrating a process of a main control circuit.
Figure 23:
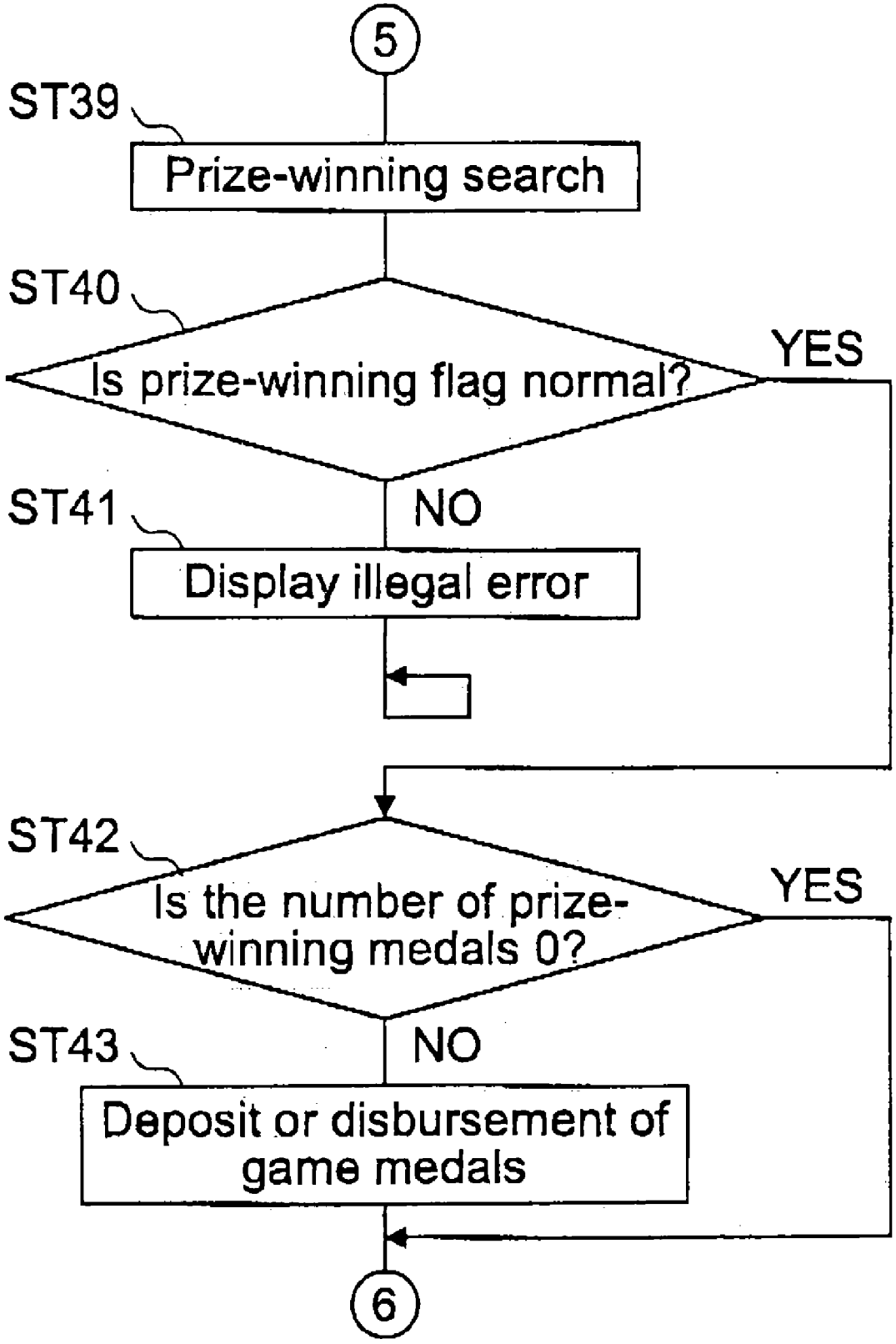
FIG. 23 is a flowchart illustrating a process of a main control circuit.
Figure 24:
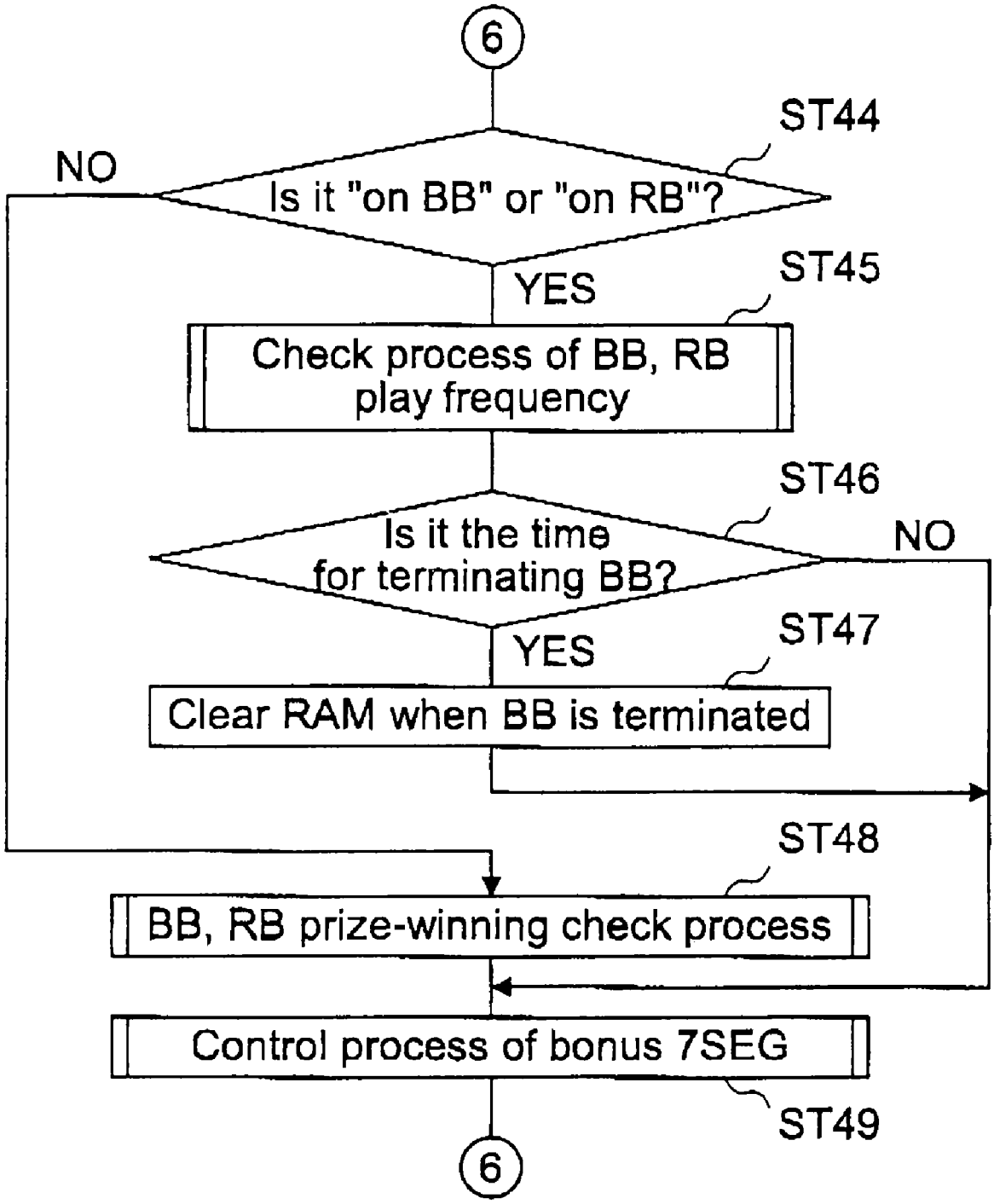
FIG. 24 is a flowchart illustrating a process of a main control circuit.
Figure 25:
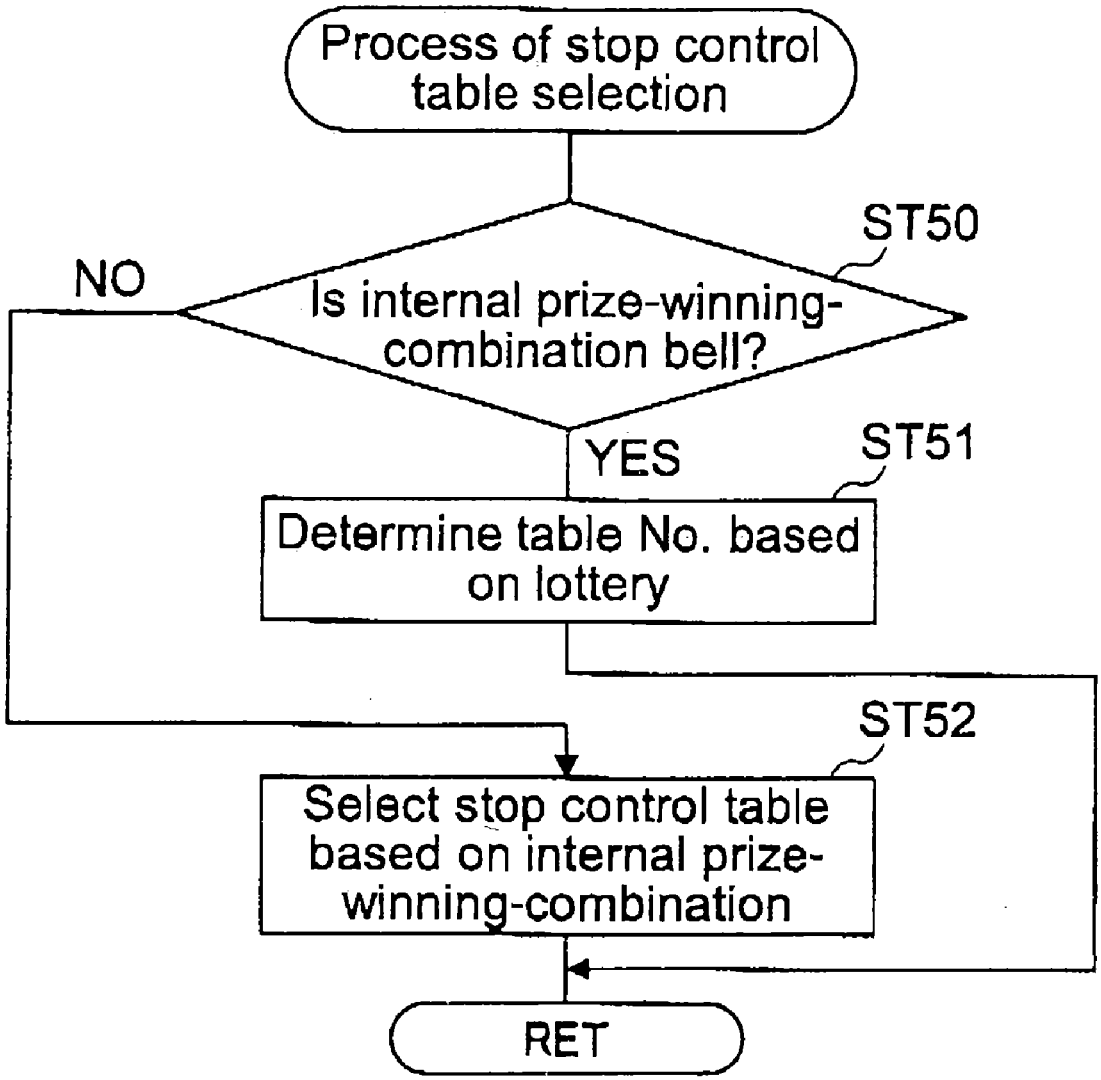
FIG. 25 is a flowchart illustrating a stop control table selection process.

Next, referring to FIG. 8, an image (image which informs the stop sequence), which is displayed on the display screen 5*a* when the internal-win achieves the "bell's insignificant winning-combination" during the assistance period, is described.

In this case, by driving the second liquid crystal panel 502 and masking the backside of the scale portion at this time, the image for informing the stop sequence by the liquid crystal display can also be visually identified extremely clearly. Furthermore, a case where the stop sequence required for achieving the prize-winning is "LEFT RIGHT CENTER" is described in this FIG. 8.

FIG. 8 (1) illustrates an image which is displayed when the game starts. The pattern of the bell is shown on the display area at the left side of the image, it is shown that the internal-win has achieved the "bell's insignificant winning-combination." Then, a message "=LEFT=PUSH!" is further displayed at the lower part of the pattern of this bell, and it notifies that the stop operation required for winning the prize is to operate the left stop button 7L as the first stop operation.

FIG. 8 (2) illustrates an image displayed after the first stop operation is performed. The pattern of the bell is shown in the pattern display area at the right side of the image, under the pattern of this bell, "=RIGHT=PUSH!" is displayed to notify that the right stop button 7R should be operated as the second stop operation.

FIG. 8 (3) illustrates an image displayed after the second stop operation is performed. The pattern of the bell is displayed in the pattern display area at the center of the image, under the pattern of this bell, "=CENTER=PUSH!" is displayed to notify that the central stop button 7C should be operated as the third stop operation. When the first and the second stop operations according to the display content of the display screen 5*a* are performed, "bell-bell-bell" is lined up along the effective line after the third stop operation, thereby the prize-winning of the "bell's insignificant winning-combination" is achieved.

Although, in FIG. 8, the stop button, which should be operated next, is sequentially notified as a mode which notifies the "stop sequence," all "stop sequences" may be notified at a time when the game starts. For example, it is also possible to display on the display screen 5*a* Like "LEFT RIGHT CENTER" as the "stop sequence."

Figure 3:
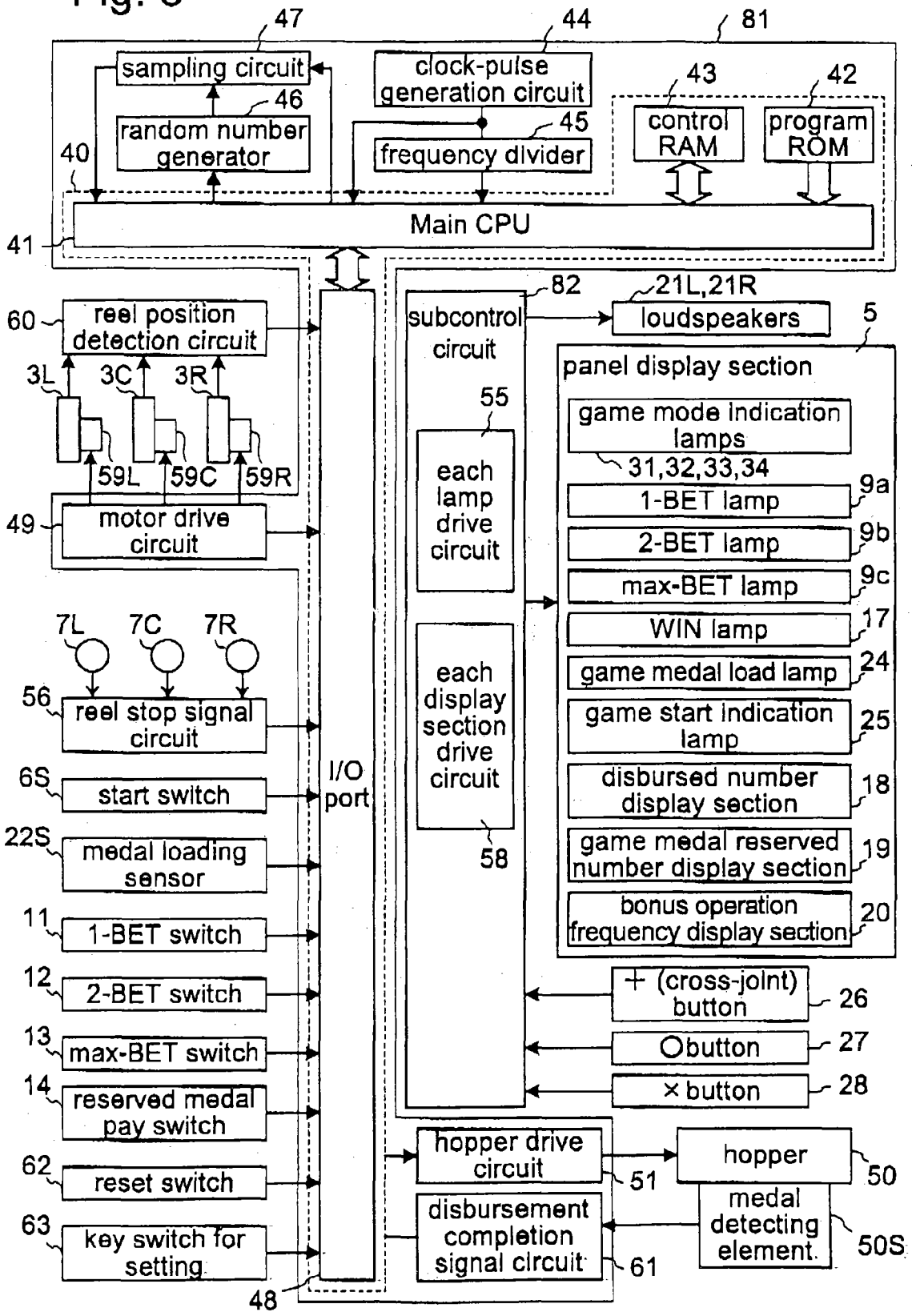
FIG. 3 is a block diagram illustrating a configuration of an electric circuit of a slot machine according to an embodiment of the present invention.

FIG. 3 illustrates a circuit configuration including a main control circuit 81 which controls the game process operation in the gaming machine 1, peripheral equipment (actuator) electrically connected to the main control circuit 81, and a subcontrol circuit 82 which controls the panel display section 5, which is a liquid crystal display, and the loudspeakers 21L and 21R based on the control command which is transmitted from the main control circuit 81.

The main control circuit 81 is comprised of a microcomputer 40 arranged on a circuit board as a main component and a circuit for a random number sampling thereto. The microcomputer 40 includes a CPU 41 which performs a control action according to a program set up in advance, and a ROM 42 and RAM 43 which are storage means.

A clock-pulse generation circuit 44, a frequency divider 45 which generate a reference clock pulse, a random number generator 46 which generates a random number to be sampled, and a sampling circuit 47 are connected to the CPU 41. The means for a random number sampling may be configured so that the random number sampling may be performed within the microcomputer 40, namely, on an operation program of CPU 41. In that case, the random number generator 46 and the sampling circuit 47 may be omitted, or left as a backup for use in the random number sampling operation.

A probability lottery table used for judgment of the random number sampling performed whenever the start lever 6 (start operation) is operated, a stop control table for determining the stop mode of the reel according to the operation of the stop button, and various control commands for transmitting to the subcontrol circuit 82 (command) or the like are stored in the ROM 42 of the microcomputer 40. These commands include a "demonstration display command," a "start command," an "all reels stop command," and a "prize-winning-combination command." These commands will be described later. Furthermore, the subcontrol circuit 82 does not input the command, information or the like into the main control circuit 81, but communication is performed in one direction from the main control circuit 81 to the subcontrol circuit 82.

In the circuit of FIG. 3, as an actuator, whose operation is controlled by the control signal from the microcomputer 40, there are a hopper (including a drive member for disbursement) 50 which houses the medals and disburses a predetermined number of medals by a command of a hopper drive circuit 51, and stepping motors 59L, 59C, and 59R which rotate the reels 3L, 3C, and 3R.

Moreover, a motor drive circuit 49 which drives and controls the stepping motors 59L, 59C, and 59R, the hopper drive circuit 51 which drives and controls the hopper 50, a lamp drive circuit 55 which drives and controls the various lamps, and a display section drive circuit 58 which drives and controls the various display sections are connected to an output portion of the CPU 41 via an I/O port 48. These drive circuits control the operation of each actuator in response to control signals, such as a driving command outputted from the CPU 41, respectively.

Moreover, the main input signal generation means which generates an input signal required for the microcomputer 40 to generate the control command, includes a start switch 6S, the 1-BET switch 11, the 2-BET switch 12, the max-BET switch 13, the deposited medal pay switch 14, a loaded medal sensor 22S, a reel stop signal circuit 56, the reel position detection circuit 60, and a disbursement completion signal circuit 61. These are also connected to the CPU 41 via the I/O port 48.

The start switch 6S detects the operation of the start lever 6. The loaded medal sensor 225 detects the medals loaded into the medal slot 22. The reel stop signal circuit 56 generates a stop signal in response to the operation of each of the stop buttons 7L, 7C, and 7R. The reel position detection circuit 60 supplies a signal for detecting the position of each of the reels 3L, 3C, and 3R in response to a pulse signal from a reel rotation sensor to the CPU 41. The disbursement completion signal circuit 61 generates a signal for detecting a completion of the medal disbursement when a counted value (the number of medals disbursed from the hopper 50) of the medal detecting element 50S reaches a specified number data.

In the circuit of FIG. 3, the random number generator 46 generates random numbers belonging to a definite numerical range, and the sampling circuit 47 samples one random number at a proper timing after the start lever 6 has been operated. In this way, the internal-win-combination is determined based on the sampled random number and the probability lottery table stored in the ROM 42. After the internal-win-combination is determined, in order to select the "stop control table," the sampling of the random number is performed again.

After the rotation of the reels 3L, 3C, and 3R is started, counting the number of driving pulses supplied to each of stepping motors 59L, 59C, and 59R is performed, and the counted value is written in a predetermined area of the RAM 43. Reset pulses are obtained from the reels 3L, 3C, and 3R for every one revolution, and these impulses are inputted into the CPU 41 via the reel position detection circuit 60. The counted value of the driving pulse counted by the RAM 43 is cleared to "0" by the reset pulse obtained in this way. Thereby, the counted value corresponding to the rotation position within the range of one turn for each of reels 3L, 3C, and 3R is stored in the RAM 43.

In order to match the rotation positions of the above reels 3L, 3C, and 3R with the patterns drawn on the reel perimeter surfaces, a pattern table is stored in the ROM 42. In this pattern table, the code number which is sequentially given for each fixed rotation pitch of each of the reels 3L, 3C, and 3R on the basis of the rotation position that the reset pulse; mentioned above generates is associated with the pattern code that shows the patterns arranged corresponding to each code number.

Moreover, a table of the prize-winning pattern combination is stored in the ROM 42. In this table of the prize-winning pattern combination, the combination of patterns which wins the prize, the number of medals as a distribution for the prize-winning, and a prize-winning judgment code showing that prize-winning are correspondingly recorded The above-mentioned table of the prize-winning pattern combination is referred to at the time of the stop control of the left reel 3L, the central reel 3C, and the right reel 3R, and then confirming the prize-winning after all reels stop.

When the internal-win is achieved by the lottery process (probability lottery process) based on the above-mentioned random number sampling, the CPU 41 sends to the motor drive circuit 49 an operation signal which is sent from the reel stop signal circuit 56 at a timing for the player to operate the stop buttons 7L, 7C, and 7R, and a signal which performs the stop control of the reels 3L, 3C, and 3R based on the selected "stop control table."

If the stop mode showing the prize-winning achievement of the winning-combination, which has achieved the internal-win, is entered, the CPU 41 will supply a disbursement command signal to the hopper drive circuit 51, and will disburse a predetermined number of medals from the hopper 50. At that time, the medal detecting element 50S counts the number of medals to be disbursed from the hopper 50, and when the counted value reaches a specified number, the medal disbursement completion signal is inputted into the CPU 41. Thereby, the CPU 41 stops the drive of the hopper 50 via the hopper drive circuit 51, and a "medal disbursement process" is completed.

Figure 4:
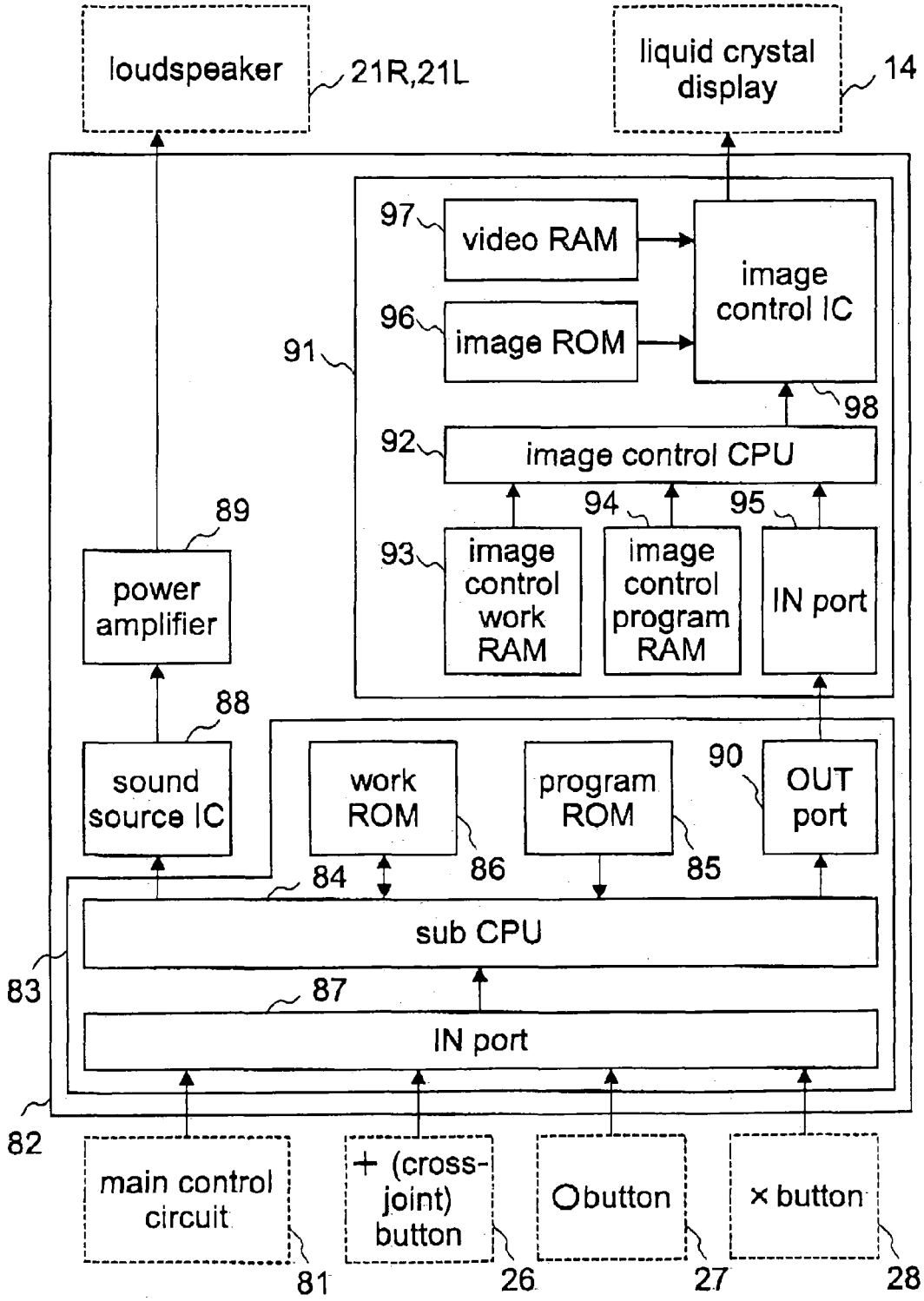
FIG. 4 is a block diagram illustrating a configuration of a subcontrol circuit of a slot machine according to an embodiment of the present invention.

The block diagram of FIG. 4 illustrates a configuration of the subcontrol circuit 82. Based on the control command (command) from the main control circuit 61, the subcontrol circuit 82 controls the display of the various lamps (1-BET lamp 9*c*, 2-BET lamp 9*b*, max-BET lamp 9*c*, WIN lamp 17) on the panel display section 5, various display sections (disbursement display section 16, game medal deposited number display section 19, and bonus operation frequency display section 20) and other displays such as for various images, while controlling the drive of the second liquid crystal panel 502 and controlling the output of the sound from the loudspeakers 21L and 21R. Furthermore, if a shutter structure is mechanical, it is also made to perform control of the motors used as a shutter driving source.

This subcontrol circuit 82 is configured on a circuit board other than a circuit board which configures the main control circuit 81, uses a microcomputer (hereinafter referred to as "sub-microcomputer") 83 as a main component, and comprises an image control circuit 91 as the display control means for the panel display section 5, a sound source IC 88 which controls the sound outputted by the loudspeakers 21L and 21R, and a power amplifier 89 as an amplifier.

The sub-microcomputer 83 includes a sub CPU 84 which controls the operation according to the control command transmitted from the main control circuit 81, a program ROM 85 as a storage means, and a work RAM 86. Although the subcontrol circuit 82 does not include the clock-pulse generation circuit, the frequency divider, the random number generator, and the sampling circuit, it is configured so that the random number sampling may be carried out on the operation program of the sub CPU 84.

The sub-microcomputer 83 comprises a notice frequency counter, an AT frequency stock counter and the like in a predetermined storage area. The notice frequency counter stores the remaining number of push order notices during a stop operation assistance period. When this counter value is "1 or more," it indicates the stop operation assistance period. The AT frequency stock counter stores information regarding the remaining number of times of stop operation assistance period generation.

The program ROM 85 saves a control program performed by the sub CPU 84. The work RAM 86 is configured as a temporary storage means when performing the above-mentioned control program using the sub CPU 84.

The image control circuit 91 comprises an image control CPU 92, an image control work RAM 93, an image control program ROM 94, an image ROM 96, a video RAM 97, and an image control IC 98. The image control CPU 92 determines display contents in the panel display section 5 according to the image control program stored in the image control program ROM 94 based on the parameters set up by the sub-microcomputer 83. The image control program ROM 94 stores the image control program of a display in the panel display section 5 and various selection tables. The image control work RAM 93 is configured as a temporary storage means when performing the above-mentioned image control program using the image control CPU 92. The image control IC 98 forms images according to the display content determined by the image control CPU 92, and outputs them to the panel display section 5. The image ROM 96 stores dot data used for forming the images. The video RAM 97 is configured as a temporary storage means when forming the images by using the image control IC 98.

Next, referring to FIG. 9, a probability lottery table is described.

These probability lottery tables are referred to in the probability lottery process. FIG. 9 (*a*) is used during the general game, FIG. 9 (*b*) is used during the "general game mode in BB," and the internal-win-combination of each game is thereby determined.

The random number range in any of the tables is 0–16333, and the internal-win-combination is determined using one numerical value extracted from a numerical value within the range.

For example, in the general game, when the extracted random number value is 2851, the internal-win-combination of this game is "bell-" In addition, in the general game, when the extracted random number values are 11036–16383, the internal-win-combination of the game is "LOST."

Next, referring to FIGS. 10 through 14, the stop control table used when the internal-win has achieved the "bell's insignificant winning-combination" is described.

When the "bell's insignificant winning-combination" is achieved by the internal-win, the "stop control table number selection table" illustrated in FIG. 10 determines the table to be referred to at the time when the stop control operation of each of the reels 3L, 3C, and 3R is performed. That is, when the "bell's insignificant winning-combination" is achieved by the internal-win, referring to any one of six kinds of the stop control tables, the stop control is performed based on it.

FIG. 11 illustrates a relationship between the stop control order of each of the reels 3L, 3C, and 3R in each selected table in FIG. 10 and an achievement/failure of the prize-winning. For example, when the table number selected by the stop control table number selection table in FIG. 9 is table number 1, and if the stop sequence is "LEFT CENTER RIGHT," the prize-winning of the bell will be achieved. However, if it is the other stop sequence, the prize-winning of the bell will not be achieved. That is, in order to achieve the prize-winning of the bell, it is required that the internal-win-combination is the bell and the stop control order of each of the reels 3L, 3C, and 3R performs the stop sequence corresponding to the table number.

A description will be made of the concrete stop control of each of the reels 3L, 3C, and 3R in the case where the internal-win-combination is the bell in FIGS. 12 14.

The "stop operation position" and the "stop control position" of each of the reels 3L, 3C, and 3R are shown in the "stop control table." The "stop operation position" shows the code number of the pattern, which is located at the center line 8*a*, when the stop buttons 7L, 7C, and 7R arranged correspondingly to each of the reels 3L, 3C, and 3R are operated (specifically, the center of the pattern is located above the center line 8*a*, which is the closest to the position of the center line 8*a*). The "stop control position" indicates the code number of the pattern which stops and is displayed on the position of the center line 8a when the reel, for which the stop operation is carried out, stops. Here, in this embodiment, so-called, "the number of slipping frames" is set at a maximum of "four frames." For example, during the rotation of the right reel 3R, when the "cherry" of the code number "12" arrives at the position of the center line 8*a*, if the stop button 7R is operated, the right reel 3R can be controlled to stop so that the "blue7" of the code number "08" may be stopped and displayed on the position of the center line 8*a*.

FIG. 12 illustrates the stop control table for winning. After achieving the internal-win of the "bell's insignificant winning-combination," a "bell-bell-bell" is lined up along the effective line, and then this table is used when controlling to stop the reel so that the prize-winning of the "bell's insignificant winning-combination" may be achieved.

In FIG. 12, the "stop control position" of the left reel 3L is either code number "03," "08," "11," "15," or "19," and the pattern corresponding to these is the "bell."

In FIG. 12, the "stop control position" of the central reel 3C is either code number "03," "07," "11," "15," or "19," and the pattern corresponding to these is the "bell."

In FIG. 12, the "stop control position" of the right reel 3R is either code number "01," "05," "10," "14," or "18," and the pattern corresponding to these is the "bell."

As described above, when the stop control table for winning illustrated in FIG. 12 is used for the stop control of each of the reels 3L, 3C, and 3R, the "bell" is stopped and displayed on the position of the center line 8*a*, i.e., the center of the position within the display windows 4L, 4C, and 4R, and the prize-winning will be achieved.

FIG. 13 illustrates a stop control table for failure of a forward push and a center push. This table is used, after achieving the internal-win of the "bell's insignificant winning-combination," when the reel is controlled to stop so that the "bell-bell-bell" may not be lined up along the effective line (so that the prize-winning of the "bell's insignificant winning-combination" may fail to win). Here, the stop control position in relation to the stop operation position of the left reel 3L and the central reel 3C is the same as that illustrated in FIG. 11.

In FIG. 13, the "stop control position" of the right reel 3R is any one of code numbers: "02," "06," "11," "15," or "19," and the pattern corresponding to these is. "Replay."

As described above, when the stop control table for failure of the forward push and the center push illustrated in FIG. 13 is used for the stop control of each of the reels 3L, 3C, and 3R, the prize-winning of the "bell's insignificant winning-combination" is not achieved since the "bell" is stopped and displayed on the position of the center within the display windows 4L and 4C, and the "Replay" is stopped and displayed on the position of the center within the display window 4R.

FIG. 14 illustrates a stop control table for failure of a reverse push. This table is used, after achieving the internal-win of the "bell's insignificant winning-combination," when the reel is controlled to stop so that the "bell-bell-bell" may not be lined up along the effective line (so that the prize-winning of the "bell's insignificant winning-combination" may fail to win). Here, the stop control position in relation to the stop operation position of the central reel 3C and the right reel 3R is the same as that illustrated in FIG. 11.

In FIG. 14, the "stop control position" of the left reel 3L is any one of code numbers: "04," "09," "12," "17," or "20," and the pattern corresponding to these is the "Replay."

As described above, when the stop control table for failure of the reverse push illustrated in FIG. 14 is used for the stop control of each of the reels 3L, 3C, and 3R, the prize-winning of the "bell's insignificant winning-combination" is not achieved since the "Replay" is stopped and displayed on a position of the center within the left display windows 4L, and the "bell" is stopped and displayed on a position of the center within the display window 4C and 4R.

Here, in this embodiment, the "Six kinds" are employed as the stop sequences as mentioned above, only when the stop operation is performed in any one sequence according to the table number, the "bell-bell-bell" is lined up along the effective line, and the prize-winning will be achieved. For this reason, when the second stop operation is performed, it may be determined whether the "bell-bell-bell" is lined up along the effective line or not. For example, it is the case where "1" (the corresponding stop sequence is the "LEFT CENTER RIGHT") is employed as the table number, and the left reel 3L is operated as the first stop operation. That is, when the first stop operation is performed, it may not necessarily be clear whether the "bell-bell-bell" is lined up along the effective line or not. In addition, in the embodiments, it is assumed that the "bell-bell-bell" is reliably lined up along the center line 8*a*. For this reason, in the embodiment, as illustrated in FIG. 12 and FIG. 13, it is assumed that two stop control tables for failure are used. Furthermore, when the table number is "2," "3," "4," "5," or "6," the prize-winning of the "bell's insignificant winning-combination" is achieved by performing the stop operation using "LEFT RIGHT CENTER," "CENTER LEFT RIGHT," "CENTER RIGHT LEFT," "RIGHT LEFT CENTER," or "RIGHT CENTER LEFT," respectively.

Referring to FIG. 15, a "ceiling AT frequency selection table" and an "AT activating lottery table" are described. For this random number range, the "ceiling AT frequency selection table" is 0–4095 and the "AT activating lottery table" is 0–255.

Although one AT is for ten games, the "ceiling AT frequency selection table" determines how many times this AT is generated. The number of times AT is selected by one AT lottery is either "1 time," "2 times," "5 times," "10 times" or, "30 times."

According to this table, a lottery value is subtracted from the extracted random number value sequentially from a top row, and the value of the row, which becomes negative, is set as the number of times of AT occurrence. For example, when the extracted random number value is 4021, from this 4021, 2356 which is the lottery value of a first line is first subtracted, and then it becomes 1665. Since this value is positive, if 1512, which is the lottery value of a second line, is further subtracted, it then becomes 153. Since this value is positive, if 196, which is the lottery value of a third line is further subtracted, it then becomes −43. Since it becomes negative here, the number of times of the AT in this case is set to 5.

Then, the "AT activating lottery table" selects whether this AT for one time is made to be activated or not. This random number range is 0–255. Here, when activating is selected, the notice frequency of the push orders of the bell for ten games are set. That is, the AT starts here. The manner of the lottery is the same as that of the case of above-mentioned AT frequency selection table.

Referring to FIG. 16, a "ceiling activating selection table" and a "ceiling meter shift selection table" are described. This random number range of the "ceiling activating selection table" is 0–255. Moreover, a numerical value shown in the "ceiling meter shift selection table" is a difference number value used as a reference for determining whether a scale of the meter is made to shift.

As illustrated in FIG. 16 (*a*), first, the "ceiling activating selection table" is used after the BB is over, and determines the difference number value which activates the next ceiling. If 1200 of this table is chosen, the ceiling AT, which is a remedial action, is activated when the difference between the total number of the medals used for the game and the total number of the medals disbursed reaches 1200 medals. Similarly, if 1500 is chosen, the ceiling AT is activated when the difference reached 1500 medals, and if 1800 is chosen, the ceiling AT is activated when the difference reached 1800 medals.

Next, as illustrated in FIG. 16 (*b*), the "ceiling meter shift selection table" is used for determining the display of the ceiling meter level by the difference number value where the selected AT is activated and the difference number value at present. As a concrete display manner, the level is expressed using a level shown in a row whose value most approximates the difference number value at present, and does not exceed the difference number among the values in a row of the difference number values which the AT selected at present activates. For example, the difference number value which the AT, which is selected at present, activates is 1200 G, and when the difference number value at present is 821 medals, it is expressed as a level 5. Here, when the difference number value reaches 900 medals, it will be displayed to shift to level 6.

A description will be made of a command table in FIG. 17 and FIG. 18. These commands are transmitted from the main control circuit 81 to the subcontrol circuit 82, and this transmission is only one directional transmission from the main control circuit 81 to the subcontrol circuit 82. It is connected with 16 data signal lines and one signal line between the main control circuit 81 and the subcontrol circuit 82. Then, these commands are 2-byte, 4-byte, or 6-byte configuration, and in order to transmit with the 16 data signal lines, they are transmitted as one command using 1, 2, or 3 sequences.

When making a description of a start command among these commands, a selected stop control table number in the case where a type of the internal-win-combination of this game, a game mode, and an internal-win-combination are the bell is transmitted as one command. Other commands are also the same. In addition, the commands illustrated in FIG. 17 and FIG. 18 are one of the examples, and other commands also transmit information required for the control performed in the subcontrol circuit.

Next, referring to a main flowchart illustrated in FIGS. 19 through 25, the control operation of the CPU 41 of the main control circuit 81 will be described.

First, a power supply is turned on (step (hereinafter referred to as ST) 1), and the CPU 41 initializes all output ports (ST2) Then, it is judged whether there is a power-down error (ST3). Here, in a case of the power-down error, the step moves to a process of ST2, and when there is no power-down error, the step moves to a process of ST4. The CPU 41 is initialized during the process of ST4. Then, it is judged whether there is a RAM error (ST5). Here, in a case of the RAM error, the RAM error is displayed. Specifically, "rr" is displayed on a medal disbursement indicator configured by a 7-segment LED. The RAM error means a problem where a RAM 78 cannot properly be read and written.

Then, when there is no RAM error, it is judged whether a key type switch for setting is "ON" (ST6). When the key type switch for setting is "ON," the step moves to a process of ST12 after performing setting processes of six levels. Moreover, when the key type switch for setting is "OFF," the step moves to a process of ST8. In the process of ST8, it is judged whether a battery backup is normal. When the battery backup is normal, after clearing a return address and an unused area of the RAM 78, all registers are returned to the output state when the power supply is "OFF" (ST9), and an input port is updated in a state when the power supply is recovered, and is returned to a state when the power supply is "OFF" (ST10).

When the battery backup is not normal, an initial value of the setting value is set (ST11). Then, all areas of the RAM 78 are cleared (ST12). Here, processes after ST12 are also performed when the key type switch for setting is "ON" in the judgment of ST6, and the step proceeds via six levels of the setting processes. Then, each setting value is stored (ST13) and communications data is initialized (ST14). Then, the CPU 41 clears the RAM 78 when the game is terminated (ST15). Then, it is judged whether there is any automatic medal loading request (ST16). A case where there is a request for automatic loading indicates a case where the prize-winning of the re-game is achieved in the previous game. When there is an automatic medal loading request, after automatically loading the medals which meets the loading request (ST17) and transmitting a game medal loading command to the subcontrol circuit, the step moves to a process of ST20. When there is no automatic medal loading request, loading of the medals from the medal slot and the bet button is accepted (ST19), and the step moves to a process of ST20.

In the process of ST20, it is judged whether the start lever is "ON," and when the start lever is "ON," it is judged whether 4.1 seconds have passed since the previous game (ST21). Specifically, it is judged based on a value of a one game watch-dog timer set in the process of ST24 described later. When 4.1 seconds have not elapsed since the previous game, game start waiting time is consumed (ST22), and the step moves to a process of ST23.

In the process of ST23, the CPU 41 extracts a random number for the lottery. Specifically, the random number is extracted from the range of 0–16383. Then, the one game watch-dog timer is set (ST24), and a game mode monitor process for judging the present game mode is performed (ST25). Next, a probability lottery process is performed. In this probability lottery process, an internal-win-combination is determined based on a random number value extracted in the process of ST23 and a probability lottery table corresponding to the present game mode which is judged by the game mode monitor process. The random number value which is the internal-win for each prize-winning-combination is defined in advance, on the probability lottery table as mentioned above.

Next, the CPU 41 performs a winning indicator lamp lighting lottery process (ST27), and performs a stop control table selection process (a detailed discussion regarding this stop control table selection process will be mentioned later) (ST28). Then, a start command is transmitted to the subcontrol circuit as a transmission process at the time of game start (ST29), and an initialization is performed for the reel rotation start (ST30).

Next, the CPU 41 judges whether the stop button is "ON" (ST31) when the stop button is "ON," the step moves to a process of ST33, and when the stop button is "OFF," the step moves to a process of ST32. In the process of ST32, it is judged whether a value of an automatic-shutdown timer is "0," when the value of the automatic-shutdown timer is "0," the step moves to a process of ST33, and when the value of the automatic-shutdown timer is not "0," the step moves to a process of ST31. In the process of ST33, the number of slipping frames is determined from a winning request (internal-win-combination), a pattern position (rotation position of the reel at the time of the stop operation), the selected stop control table or the like.

Then, the reel is rotated by the amount corresponding to the number of slipping frames which is determined by the process of ST33 (ST34). Next, a stop request of the reel is set (ST35), and the reel stop command is transmitted to the subcontrol circuit (ST36).

Then, it is judged whether all reels have stopped (ST37) when all reels have stopped, the step moves to a process of ST38, and when all reels have not stopped, the step moves to a process of ST31. Then, after carrying out the performance process at the time of game end (ST38), a prize-winning search is performed (ST39) Then, it is judged whether a prize-winning flag is normal (ST40) when the prize-winning flag is normal, the step moves to a process of ST42, and an illegal error is displayed when the prize-winning flag is not normal (ST41).

Next, it is judged whether the number of prize-winning is 0 (ST42). Specifically, it is judged whether any winning-combination for the prize-winning (except for the re-game) is achieved. When the prize-winning is achieved, reserving of the medals or a disbursement is performed according to the mode (is it "on BB" or "on RB"?) and the prize-winning-combination (ST43).

Next, the CPU 41 judges whether the mode is "on BB" or "on RB" (ST44); when it is "on BB" or "on RB," the step moves to a process of ST45, and when it is not "on BB" or "on RB," the step moves to a process of ST48. In the process of ST45, a check process of the game number of BB or RB is performed, and whether the BE is terminated (ST46) is judged. When the BB is terminated, after transmitting a BB terminating command, the RAM when the BB is terminated is cleared (ST47), and the step moves to a process of ST49. In ST46, when the BB is not terminated, the step moves to a process of ST49. In ST44, when it is not "on BB" or "on RB," a BB or RB prize-winning check process (ST48) is performed, and the step moves to a process of ST49. In the process of ST49, a bonus 7 SEG control process is performed and the step moves to a process of ST15.

Next, a stop control table selection process performed by ST28 will be described. First, the CPU 41 judges whether the internal prize-winning-combination of this game is the bell (ST50). When the internal-win-combination of this game is the bell, the step moves to a process of ST51, and when the internal-win-combination of this game is not the bell, the step moves to a process of ST52. In the process of ST51, a random number value is extracted and the one stop control table is selected based on the stop control table selection table in the process of ST52, the stop control table defined in advance for each internal-win-combination is selected.

Next, referring to FIGS. 26 through 34, a control process of the subcontrol circuit 82 will be described.

Figure 26:
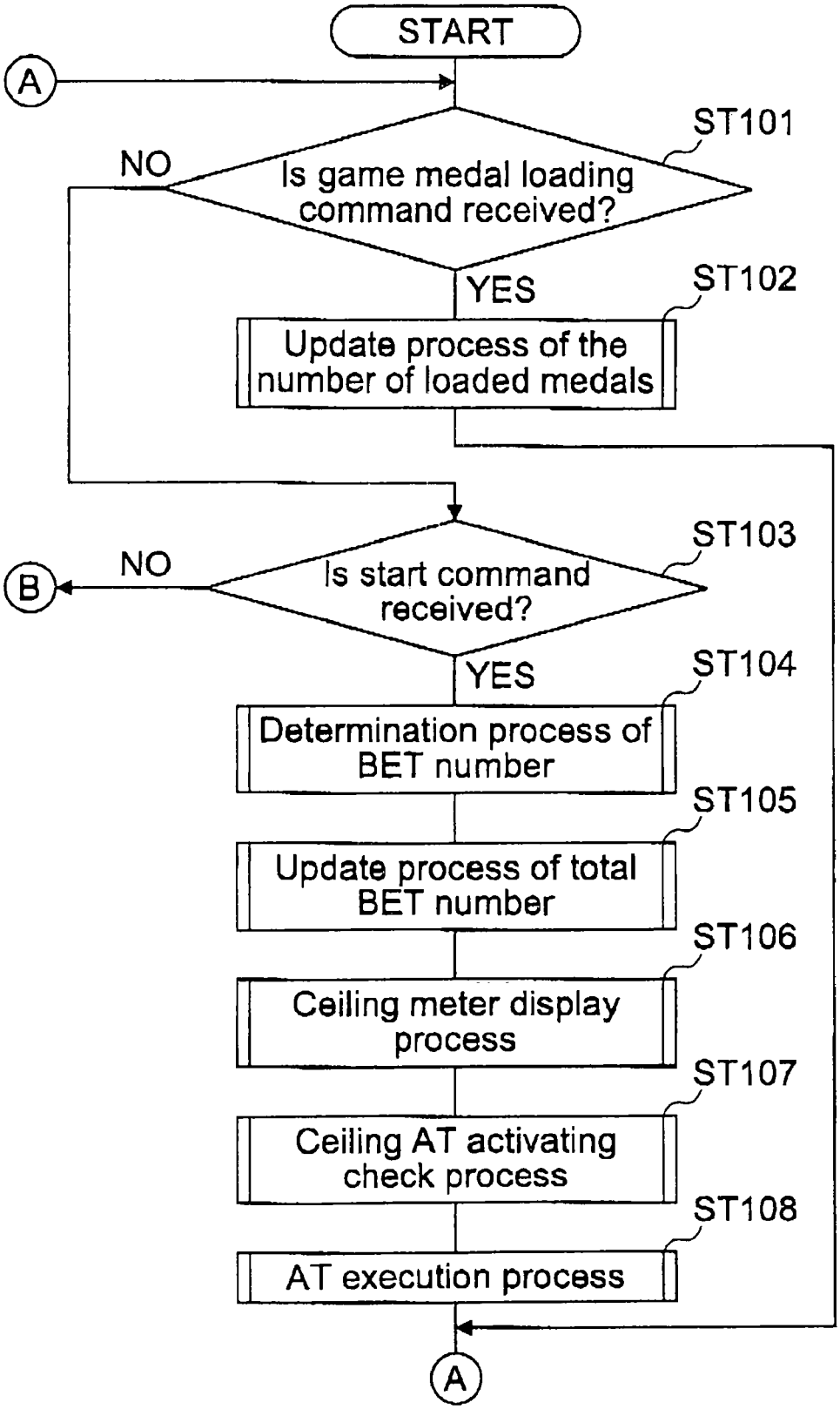
FIG. 26 is a flowchart illustrating a process of a subcontrol circuit.
Figure 27:
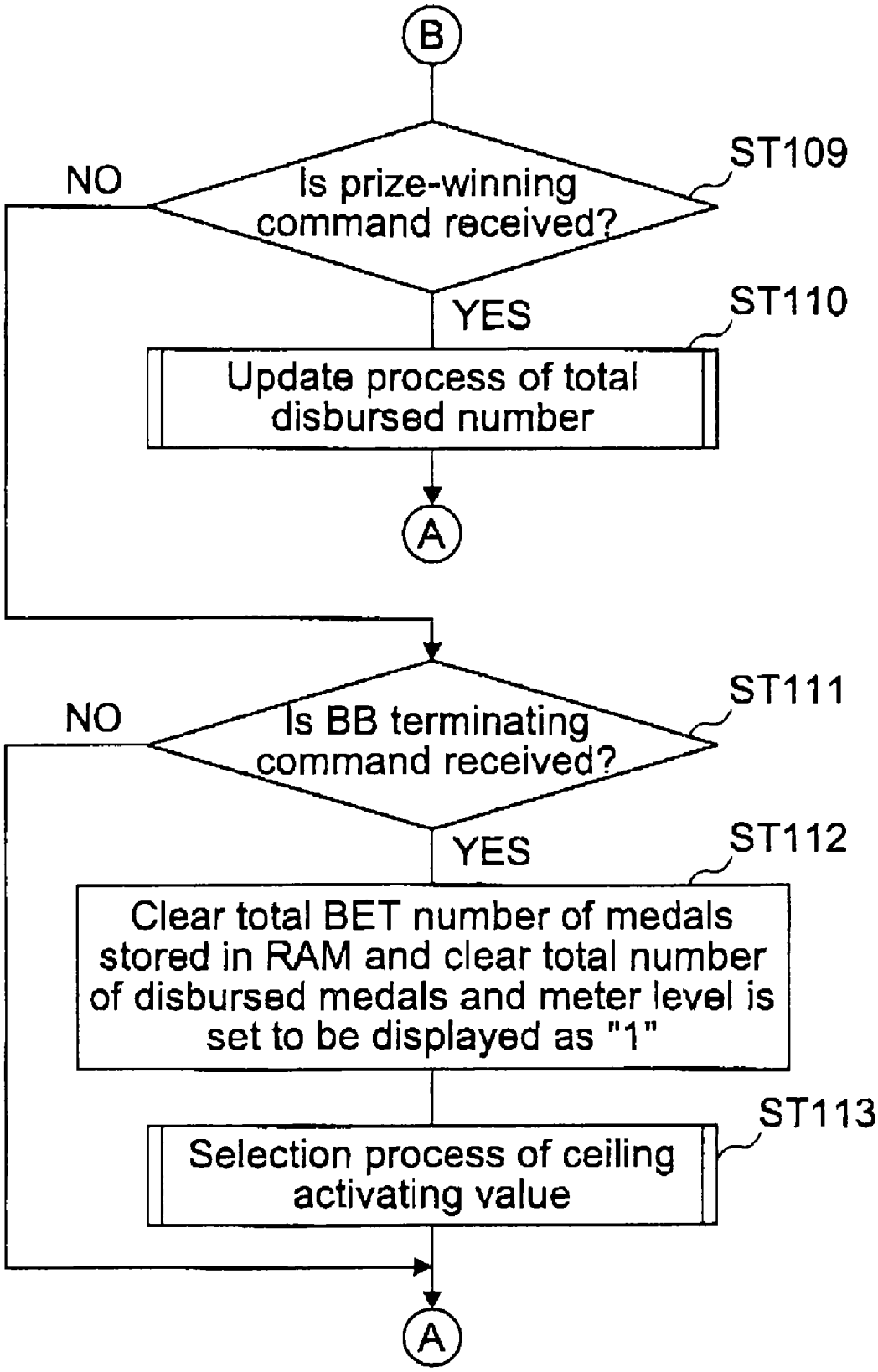
FIG. 27 is a flowchart illustrating a process of a subcontrol circuit.
Figure 28A:
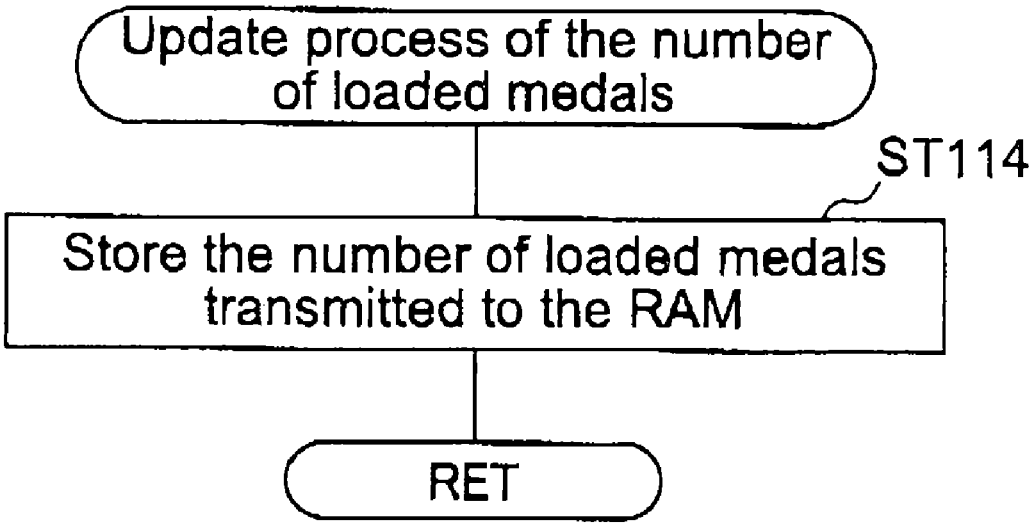
FIG. 28A is a flowchart illustrating an update process of the number of loaded medals.
Figure 28B:
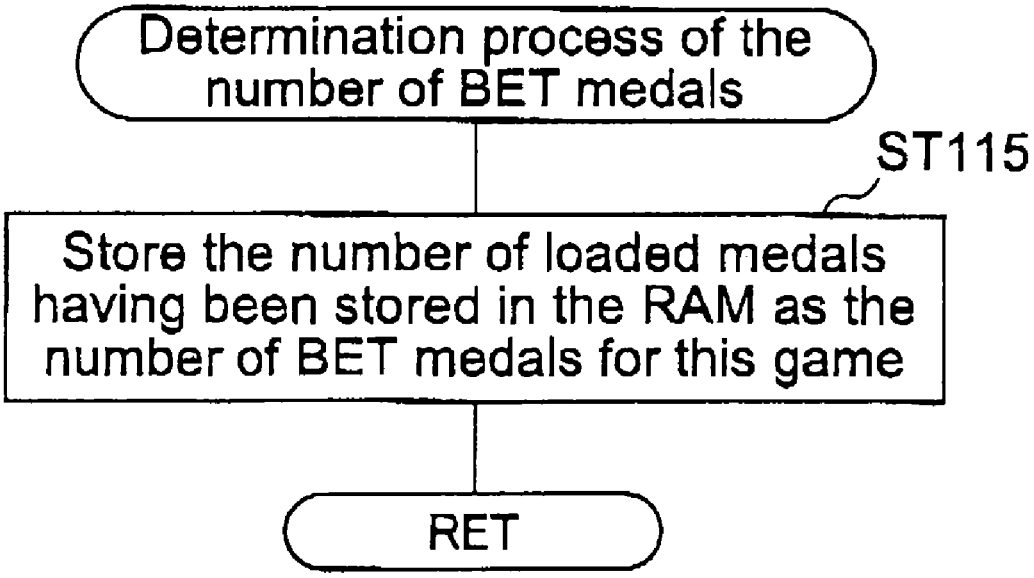
FIG. 28B is a flowchart illustrating an update process of the number of BET medals.
Figure 28C:
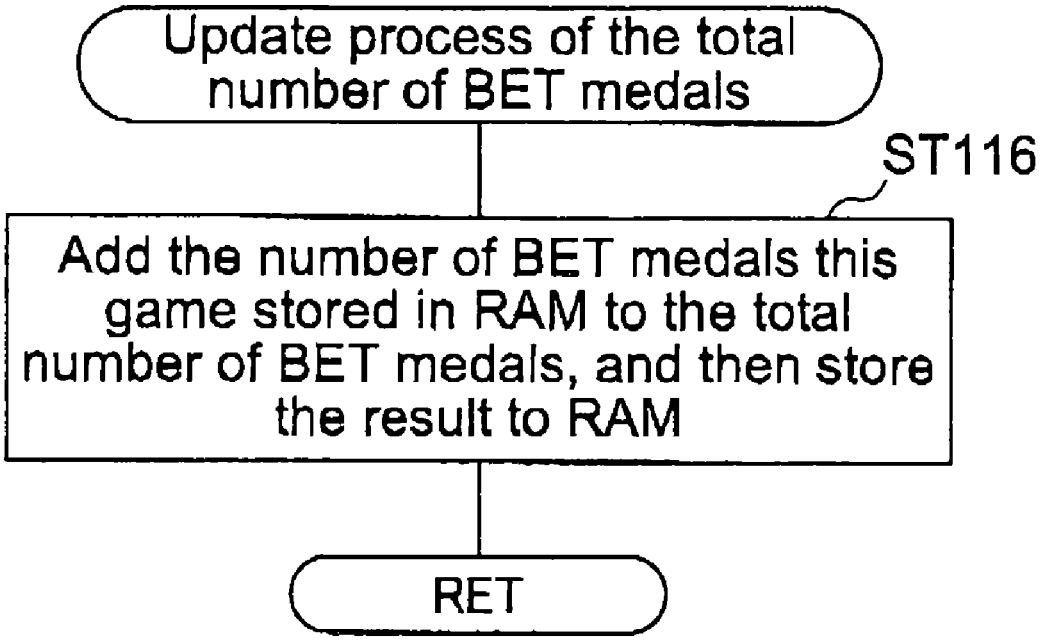
FIG. 28C is a flowchart illustrating an update process of the total number of BET medals.
Figure 28D:
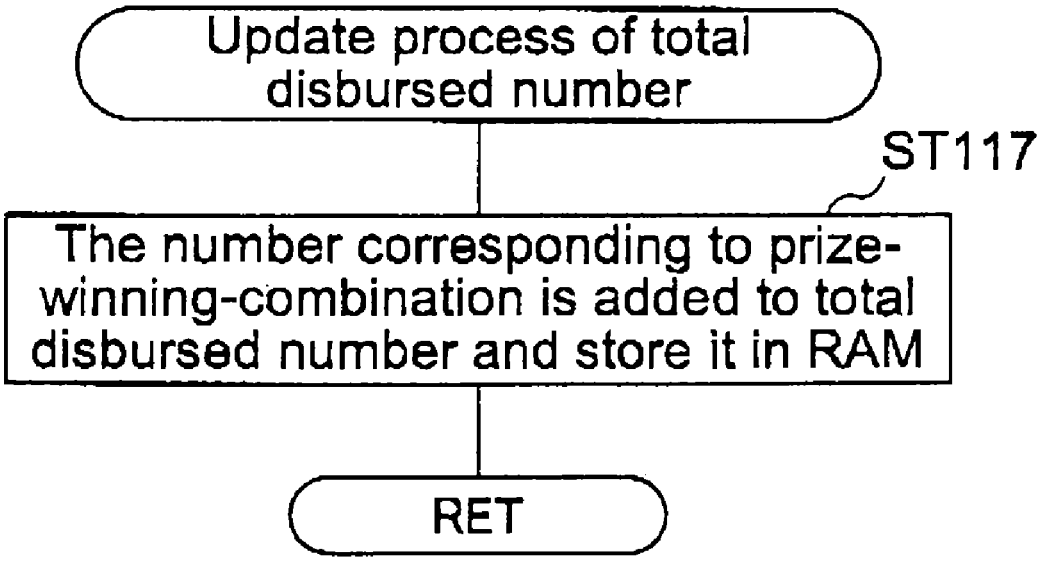
FIG. 28D is a flowchart illustrating an update process of the total disbursed number.

First, referring to FIGS. 26 and 27, a process outline of the subcontrol circuit will be described. First, the sub CPU 84 determines whether a game medal loading command has been received, namely, whether the game medals used for one game have been loaded (ST101).Here, the game medal loading command includes information, such as how many game medals are loaded or the like. When the game medal loading command is received, the step moves to a process of ST102. In the process of ST102, the loaded number, which has been changed in the start lever reception state, is updated. The step returns to the process of ST101 again after this process.

If the game medal loading command has not been received, whether the start command has been received, namely, whether one game has started, is determined (ST103). When the start command is received, after determining the BET number (the number of game media used for the game) of this game (ST104), the total BET number is updated (ST105). Subsequently, a process on the display of the ceiling meter is performed (ST106), on whether the ceiling AT activates is checked (ST107), and the AT process execution, namely a process concerning a push order notice is performed (ST108). The step returns to the process of ST101 again after this process.

When the start command has not been received in ST103, it is determined whether the prize-winning command has been received, namely, whether a predetermined prize-winning-combination has won the prize (ST109). When the prize-winning command is received, the total disbursed number is updated (ST109). The step returns to the process of ST101 again after this process.

When the prize-winning command has not been received in ST109, it is determined whether the BB terminating command has been received, namely, whether the BB has been terminated in this game (ST111). When the BB terminating command is received, the total BET number and the total disbursed number which are stored in the RAM are cleared, and the scale of the ceiling meter is displayed as 1 (ST112). Here, the judgment for activating the remedial action can be started after the BB by clearing the total BET number and the total disbursed number.

Then, the ceiling activating value selection process determines a next ceiling activating value (ST113). When the BB terminating command has not been received in ST111, ST112 and ST113 are not processed but the step returns to the process of ST101 again.

FIG. 28 describes a loaded number update process shown in ST102, a BET number determination process shown in ST104, a total BET number update process shown in ST105, and a total disbursed number update process shown in ST110.

The loaded number update process illustrated in FIG. 28(*a*) stores the loaded number which is transmitted in a predetermined area of the RAM once (ST111). Then, the BET number determination process illustrated in FIG. 28(*b*) determines the loaded number stored in the RAM in ST110 as the BET number of this game, and stores it in the RAM (ST111). Thus, the reason why the loaded number is monitored in the loaded number update process and the BET number is determined after receiving the start command is to determine the BET number at the time of the start lever operation when loading the game medals by operating the 1-BET switch 11, the 2-BET switch 12, and the max-BET switch 13, since it is configured so that the loaded number can be changed before the start lever operation.

In FIG. 28(*c*), the BET number of this game determined by ST111 is added to the total BET number (used game media). For example, three is added when the BET number in this game is three. Performing this process for each game makes the calculation of the total BET number possible. Then, in FIG. 28(*d*), the disbursed number is added to the total disbursed number when the disbursement is made. For example, when a prize of a plum is won, 6 is added, and 0 is added when there is no prize-winning. Performing this process for each game makes the calculation of the total disbursed number possible.

Figure 29:
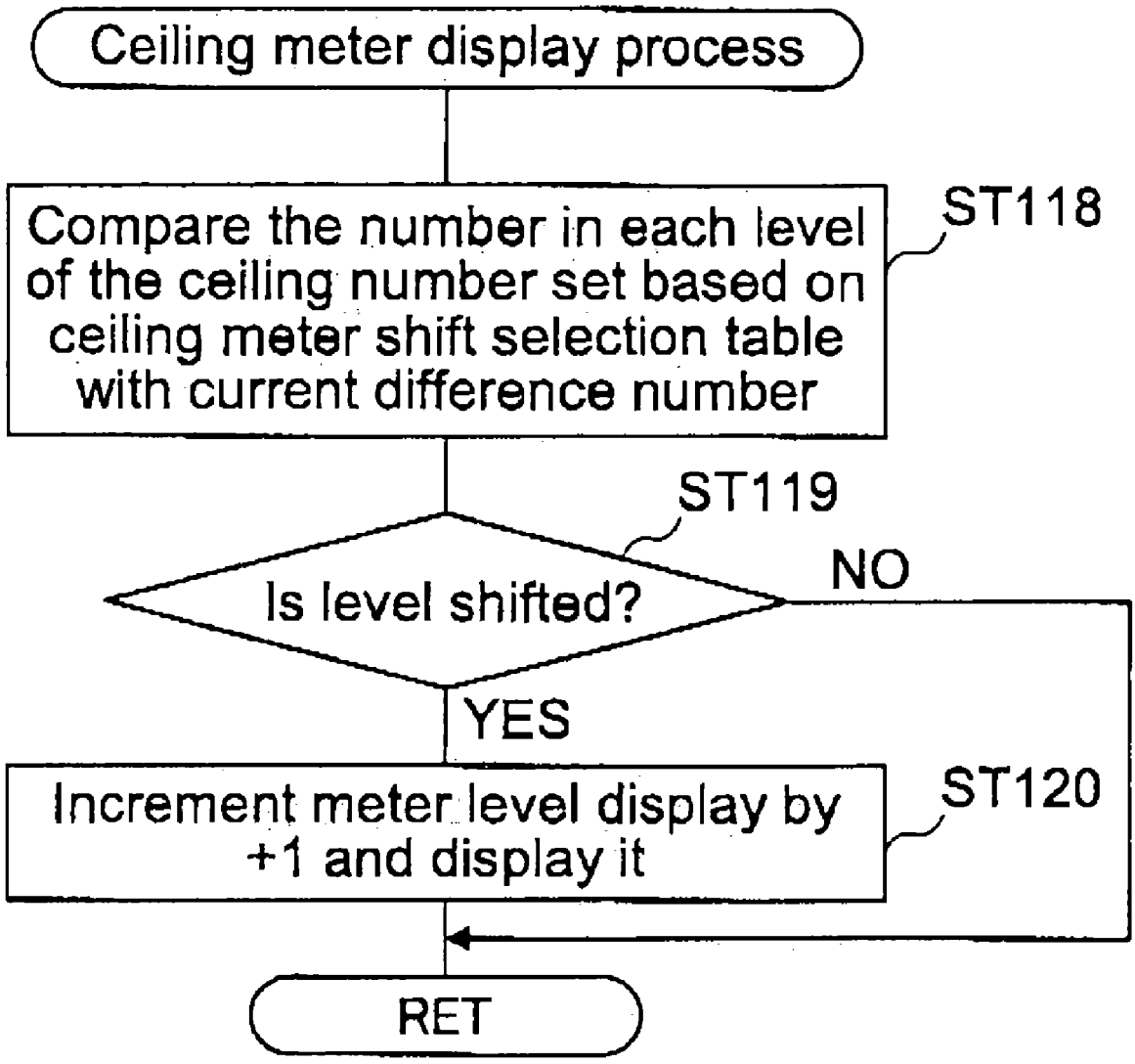
FIG. 29 is a flowchart illustrating a ceiling meter process.

FIG. 29 illustrates the ceiling meter display shown in ST106. In this process, first, the number in each level of the ceiling number which is set based on the ceiling meter shift selection table, and the display level of the ceiling meter based on the present difference number are determined (ST118). Then, it is judged whether the level, which is currently displayed is made to shift (ST119). When shift is made, the meter level is displayed by incrementing the current level by +1 (ST120), when the shift is not made, the process is made to return.

Figure 30:
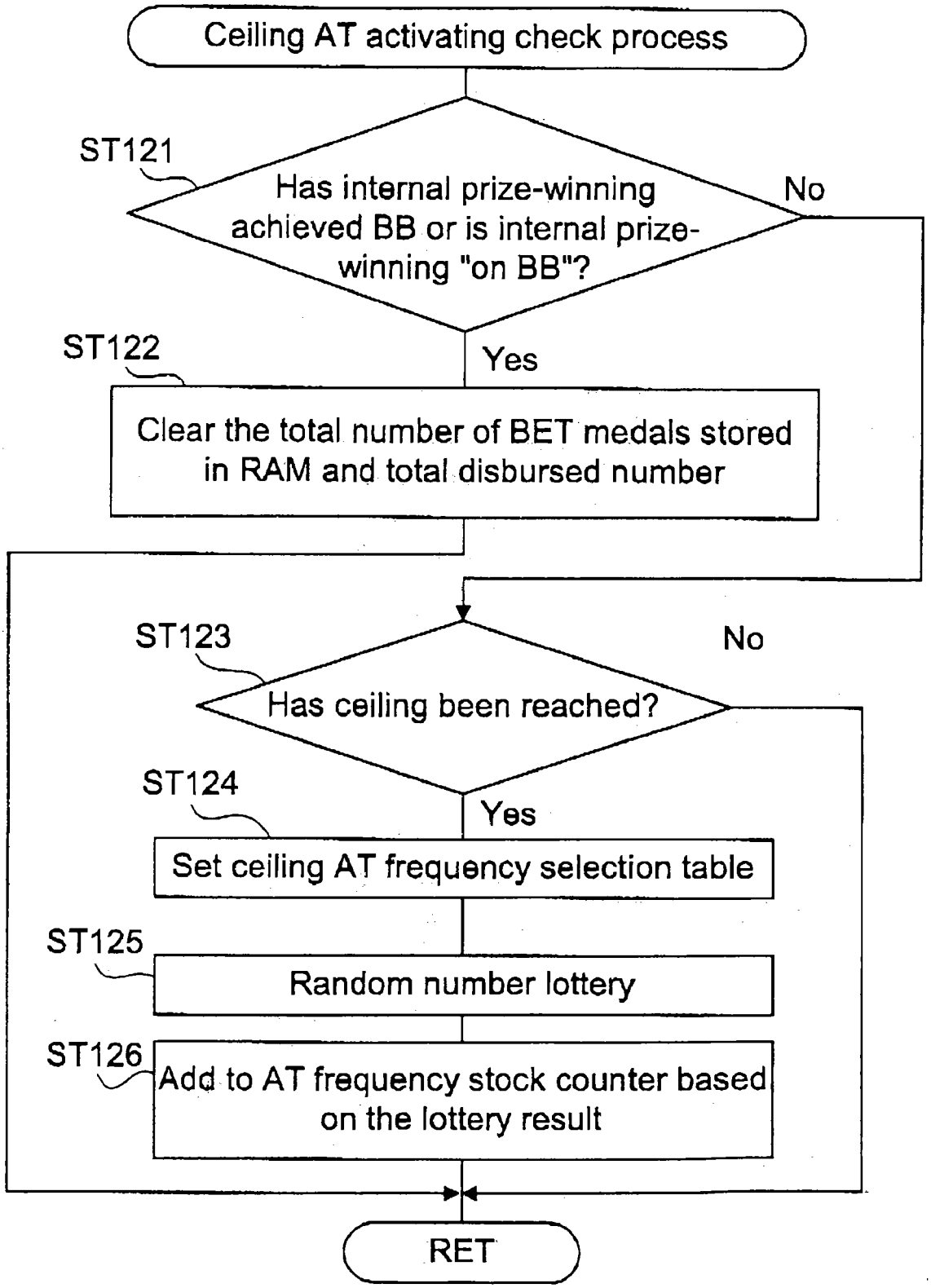
FIG. 30 is a flowchart illustrating a ceiling AT activating check process.

FIG. 30 illustrates the ceiling AT activating check process shown in ST107. This ceiling AT means a stop operation assistance period which is activated as a remedial action, since the ceiling AT is activated when a predetermined value (ceiling value which is set) is reached, an expression called a ceiling is used. Moreover, the predetermined value is determined by the ceiling activating value selection process performed after the BB is terminated, and is either 1200, 1500, or 1800.

In this process, first, it is judged whether the internal-win has achieved the BB in this game, or the current game mode is on the internal win of the BB (ST121). When the internal-win has achieved the BB in this game, or when the current game mode is on the internal-win of the BB, the total BET number and the total disbursed number which are stored in the RAM are cleared (ST122), and the process is returned. Thereby, once the internal-win has achieved the BB, unless the BB will be terminated, the remedial action is not activated.

Then, when the internal-win has not achieved the BB in this game, and the current game mode is not on the internal-win of the BB either, a judgment is carried out whether the current difference number has reached the ceiling value which has been set (ST123) Here, when the current difference number is equal to or greater than the ceiling value, the ceiling AT frequency selection table is set (ST124), a random number lottery is performed based on this (ST125), and the value selected by this lottery is added to the AT frequency stock counter (ST126). Moreover, in the judgment of ST123, when the current difference number is smaller than the ceiling value, the process is returned.

Figure 31:
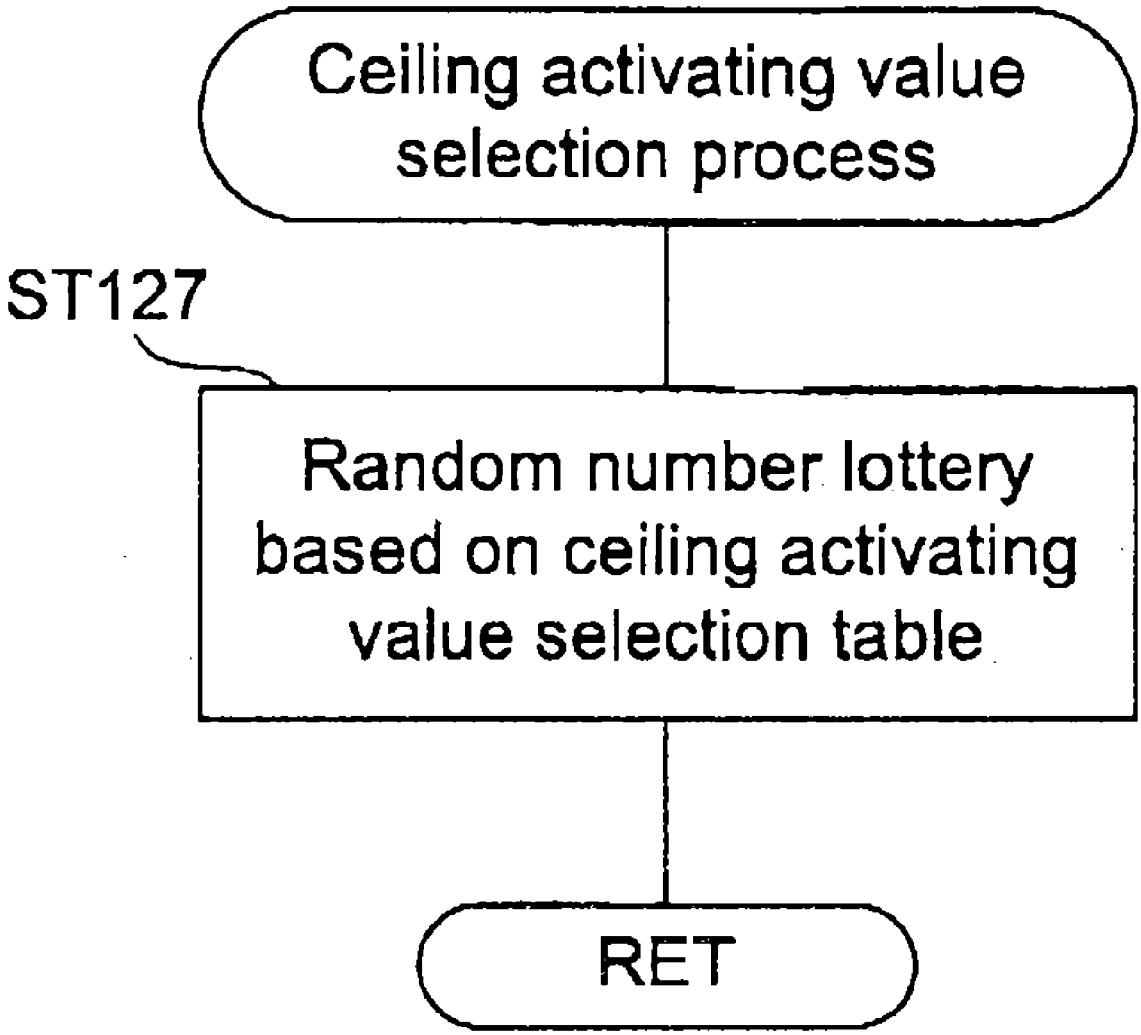
FIG. 31 is a flow chart illustrating a ceiling activating value selection process.

FIG. 31 illustrates the ceiling activating value selection process shown in ST113. This process is performed after the BB is terminated and determines the number of games, namely the ceiling value, for which the next remedial action activates. This process is held in the RAM until the random number lottery is performed based on the ceiling activating value selection table, any value of 1200, 1500, and 1800 is selected, the next BB is terminated, and a ceiling value is newly selected. Thus, by selecting and determining the ceiling value, the ceiling value is not fixed and it prevents the player from easily determining when the next remedial action is activated.

Figure 32:
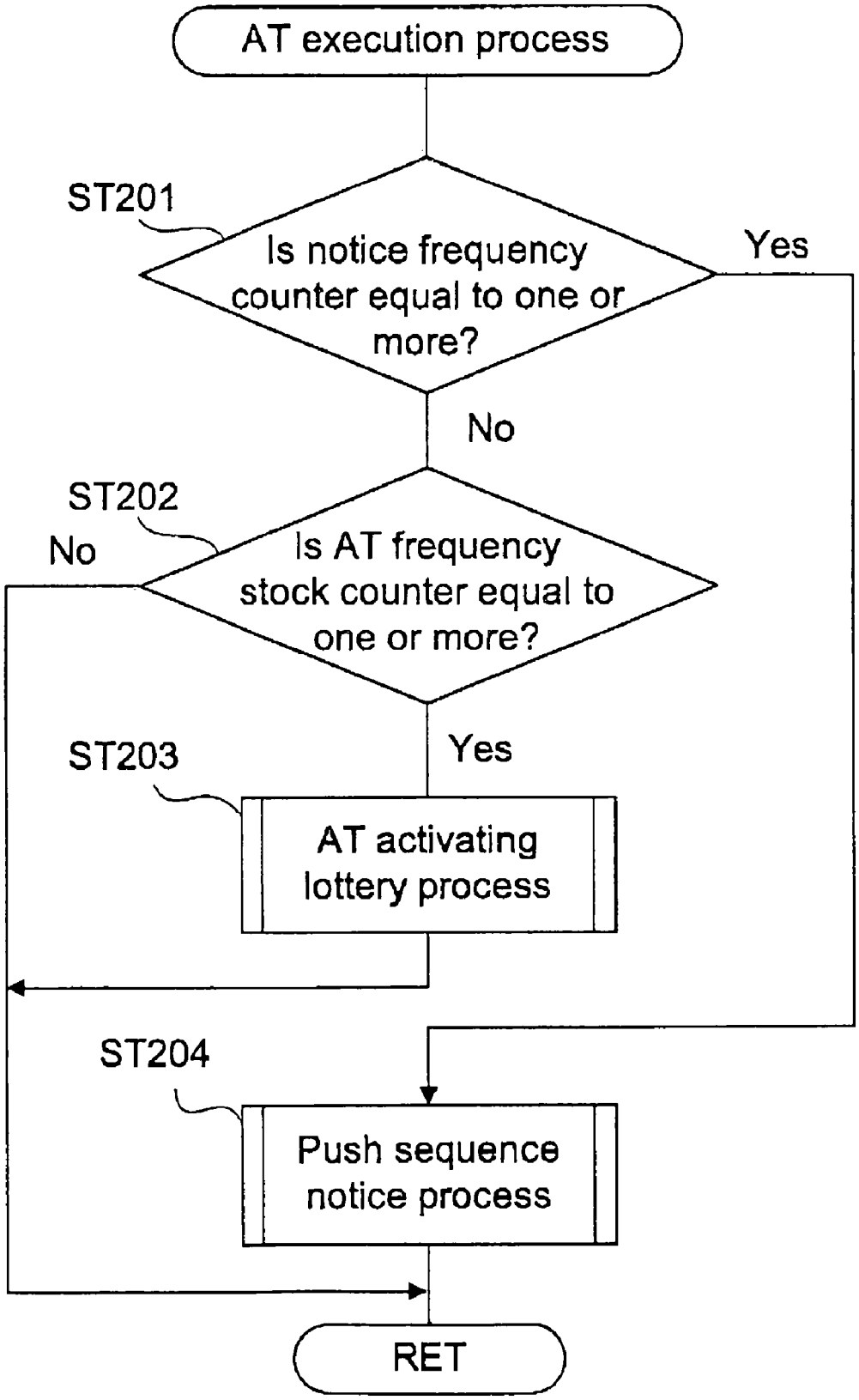
FIG. 32 is a flowchart illustrating an AT execution process.

FIG. 32 illustrates the AT process execution shown in ST108.

First, it is judged whether a value of the notice frequency counter is equal to or greater than one (ST201). When the value of the notice frequency counter is equal to or greater than one, the push order notice process (ST204) is performed. Then, when the value of the notice frequency counter is not equal to or greater than one, it is judged whether the value of the AT frequency stock counter is equal to or greater than one (ST202). When the value of the AT frequency stock counter is not equal to or greater than one, the process is returned, and when the value of the AT frequency stock counter is equal to or greater than one, an AT activating lottery process (ST203) is performed.

When the value of the above-mentioned notice frequency counter becomes equal to or greater than one, it is shown that the mode is on AT. When the value of the AT frequency stock counter becomes equal to or greater than one, it is shown that the mode is during an AT latent period.

Figure 33:
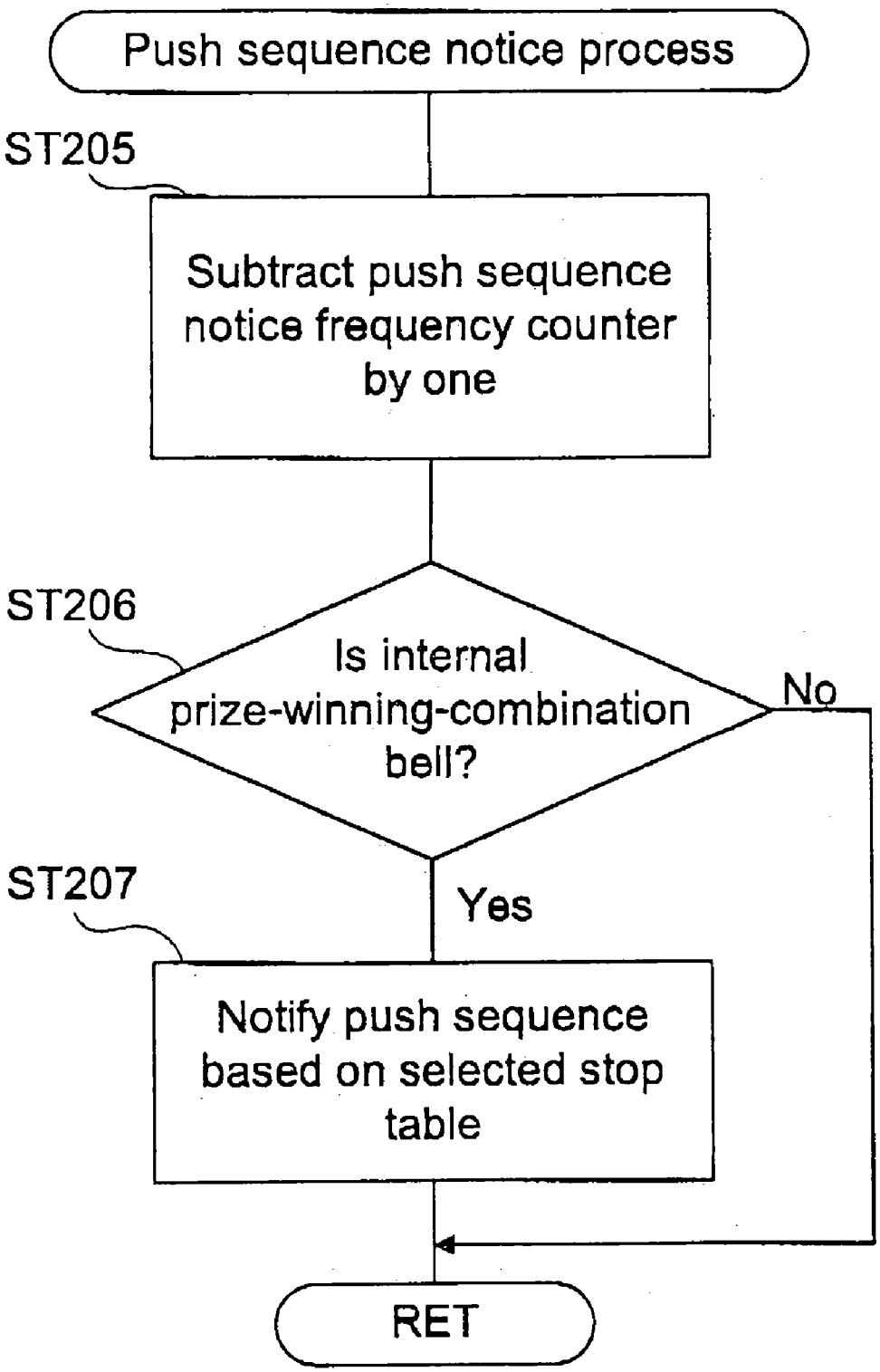
FIG. 33 is a flowchart illustrating a push order information process.

FIG. 33 illustrates the push order notice process shown in ST204. First, the value of the push order notice frequency counter is subtracted by one (ST205). Then, it is judged whether the internal-win-combination of this game is the bell (ST206). The process is returned when the internal-win-combination of this game is not the bell, however, when the internal-win-combination of this game is the bell, information for making the bell win a prize based on the selected stop control table number is notified (ST207), and the process is returned.

Figure 34:
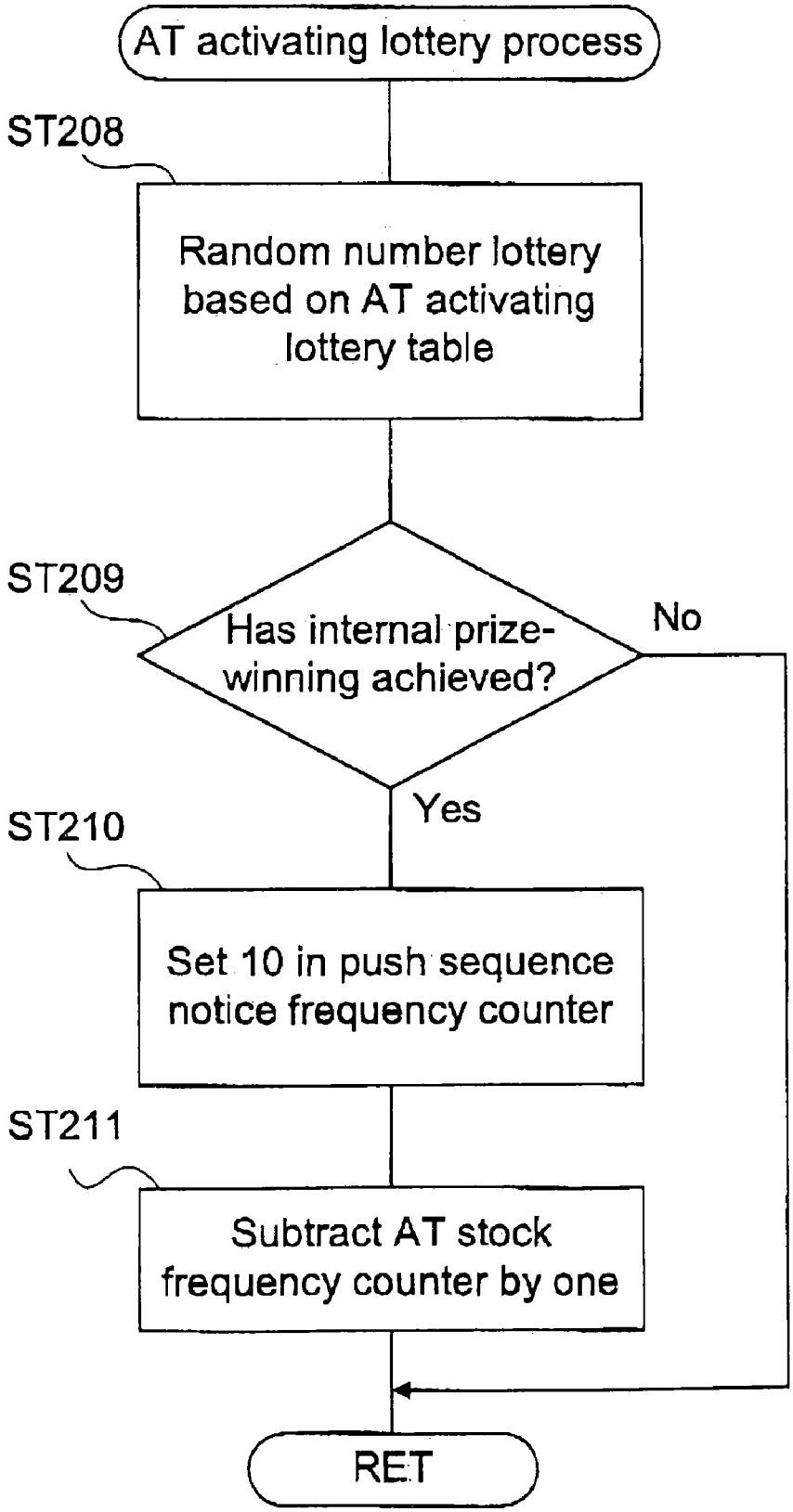
FIG. 34 is a flowchart illustrating an AT activating lottery process.

FIG. 34 illustrates the AT activating lottery process shown in ST203.

First, a random number lottery is performed based on the AT activating lottery table (ST208). As a result of this lottery, it is judged whether the AT activation is won (ST209), when the AT activation is not won, the process is returned, and when the AT activation is won, a value of 10 is added to the push order notice frequency counter (ST210), the value of the AT frequency stock counter is subtracted by one (ST211), and the process is returned.

In the steps of the process mentioned above, when displaying various kinds of displays on the panel display section 5, by driving and controlling the above mentioned first liquid crystal panel 501 and the second liquid crystal panel 502 separately, it becomes possible to clearly and variously display the information or the like to be displayed on the display screen 5*a* compared with the conventional one, satisfactorily maintaining the visibility of the portion of the rotation reels 3L, 3C, and 3R.

As mentioned above, although the present invention has been described through the above-mentioned preferred embodiments, the present invention is not limited to this. In one preferred embodiment, although clearing the total disbursed number and the total BET number is performed at the time of the BB internal-win, during the BB internal-win, and at the time of the BB prize-winning, this timing may be set up arbitrarily, and the configuration may be so that the process of the aforementioned clearing may not be employed.

Moreover, in the above-mentioned preferred embodiment, although it is configured for the stop operation assistance period to be activated whenever the difference number reaches the predetermined number, this remedial action may be performed a predetermined number of times (for example, only one time) after the BB is terminated.

Moreover, by means of the AT, although the push order is notified when achievement or failure of the prize-winning is determined by the difference in push order, the AT which notifies the internal-win-combination other than this may be employed. Moreover, as a situation advantageous to the player, the BB, the RB or the like may be employed in addition to the AT in order to obtain as many game media as possible.

Moreover, the present invention is applicable to other gaming machines, such as a pachinko gaming machine (Japanese pinball) or the like other than a pachislo gaming machine described in this embodiment.

As mentioned above, according to the present invention, by configuring said front side display means so as to stack a plurality of panel-shaped displays, it becomes possible to display more clearly not only the display by the front side display means but also the display by the variable display means, and further, occasionally greater various displays are attained, thereby, increasing the amusement of the game to the player and making it possible to impressively display even the information notice.

What is claimed is:

1. A gaming machine comprising:

variable display means for variably displaying a plurality of patterns;

front side display means, which is arranged in front of said variable display means and through which said plurality of patterns of said variable display means can be seen, wherein said front side display means is configured as a stack of a plurality of panel-shaped displays, including at least three kinds of panels wherein said stack comprises at least one cover panel, at least two liquid crystal panel and at least one reflective panel;

internal prize-winning-combination determination means for determining an internal-win-combination;

stop control means for stopping and controlling a variable display operation of said variable display means based on a determination result of said internal-win-combination determination means; and game media disbursement means for disbursing game media when a stop mode of the variable display means stopped by said stop control means conforms with a predetermined stop mode.

2. The gaming machine according to claim 1, wherein one of said plurality of panel-shaped displays arranged adjacent to a side of said variable display means comprises an opening which allows said plurality of patterns of said variable display means to be seen therethrough.

3. A gaming machine including at least one variable display device showing varying images and a stop device for stopping the varying images so as to show a still image on each variable display device, the gaming machine comprising:

a front side display device comprising at least three kinds of panels, and being positioned in front of the at least one variable display device such that the gaming machine has a mode to allow the still image to be seen through said front side display device;

wherein said front side display device comprises a first display panel, a second display panel, and a third panel, wherein said second display panel and said third panel are positioned between said first display panel, and the at least one variable display device such that the gaming machine has a mode to allow the still image to be seen through said first display panel and said second display panel; and wherein said first display panel and said second display panel are capable of showing images which are dependent on each other and wherein said first display panel and said second display panel is an LCD display panel.

4. The gaming machine according to claim 3, wherein at least one of said first display panel and said second display panel comprises an opening such that at least a part of the still image of the at least one variable display device may be seen through said opening.

5. The gaming machine according to claim 3, wherein at least one of said first display panel and said second display panel comprises a plurality of openings such that at least a part of the still image of the at least one variable display device may be seen through at least one of said plurality of openings.

6. The gaming machine according to claim 5, wherein said plurality of openings are arranged so as to show the still image on the at least one variable display device through each of said plurality of opening.

7. The gaming machine according to claim 3, wherein said second display panel comprises an opening and an opaque member disposed around said opening such that at least a part of the still image of the at least one variable display device may be seen through said opening.

8. The gaming machine according to claim 3, wherein said first display panel comprises a liquid crystal panel.

9. The gaming machine according to claim 8 further comprising a reflecting plate, wherein said second display panel comprises a liquid crystal panel.

10. The gaming machine according to claim 9, wherein said reflecting plate has a convex surface.

11. The gaming machine according to claim 9, wherein said reflecting plate has a concave surface.

12. The gaming machine according to claim 3, wherein said front side display device further comprises a transparent plate with a predetermined thickness being positioned between said second display panel and at least one variable display device.

13. The gaming machine according to claim 12, wherein said front side display device further comprises a reflecting plate being positioned between said transparent plate and the at least one variable display device.

14. The gaming machine according to claim 13, wherein said front side display device further comprises a back light such that light from said back light passes through said transparent plate and is reflected on said reflecting plate.

15. The gaming machine according to claim 3, wherein said front side display device further comprises a frame for holding said first display panel and said second display panel, wherein said frame comprises a notch through which light passes.

16. The gaming machine according to claim 3, wherein said at least one variable display device comprises a rotatable reel, and wherein an image shown by said first display panel is associated with the still image on said rotatable reel.

17. The gaming machine according to claim 3, wherein the at least one variable display device comprises a rotatable reel, and wherein an image shown by said second display panel is associated with the still image on said rotatable reel.

18. The gaming machine according to claim 3, wherein said second display panel comprises a liquid crystal panel.

19. A gaming machine including at least one variable display device showing varying images and a stop device for stopping the varying images so as to show a still image on each variable display device, the gaming machine comprising:

a front side display device being positioned in front of the at least one variable display device such that the gaming machine has a mode to allow the still image to be seen through said front side display device;

wherein said front side display device comprises a first display panel a second display panel, and a third panel, with said second display panel and said third display panel being positioned between said first display panel, and the at least one variable display device such that the gaming machine has a mode to allow the still image to be seen through said first display panel and said second display panel; and wherein said first display panel and said second display panel are capable of showing images which are independent from each other wherein said second display panel and said third display panel are formed as a LCD panel.

20. The device as in claim 19, wherein said second display panel and said third display panel are in the form of liquid crystal panels arranged in a stack.

* * * * *